US008155543B2

(12) United States Patent
Ishibashi et al.

(10) Patent No.: US 8,155,543 B2
(45) Date of Patent: Apr. 10, 2012

(54) IMAGE FORMING APPARATUS CAPABLE OF REDUCING A LENGTHY DURATION OF AN ADJUSTMENT CONTROL

(75) Inventors: Hitoshi Ishibashi, Kamakura (JP); Osamu Ariizumi, Yokohama (JP); Shinji Kobayashi, Atsugi (JP); Kazumi Kobayashi, Tokyo-to (JP); Fukutoshi Uchida, Kawasaki (JP); Takashi Enami, Chigasaki (JP); Ryohta Morimoto, Ebina (JP); Shin Hasegawa, Zama (JP); Shinji Kato, Kawasaki (JP); Kohta Fujimori, Yokohama (JP); Nobutaka Takeuchi, Yokohama (JP); Kayoko Tanaka, Tokyo (JP); Yuushi Hirayama, Sagamihara (JP); Naoto Watanabe, Atsugi (JP)

(73) Assignee: Ricoh Co., Ltd., Tokyo (JP)

( * ) Notice: Subject to any disclaimer, the term of this patent is extended or adjusted under 35 U.S.C. 154(b) by 1029 days.

(21) Appl. No.: 11/492,789

(22) Filed: Jul. 26, 2006

(65) Prior Publication Data

US 2007/0025748 A1 Feb. 1, 2007

(30) Foreign Application Priority Data

Jul. 26, 2005 (JP) ..... 2005-215809

(51) Int. Cl.
*G03G 15/00* (2006.01)

(52) U.S. Cl. ..... 399/49; 399/74; 399/302

(58) Field of Classification Search ..... 399/72, 399/49, 74, 302
See application file for complete search history.

(56) References Cited

U.S. PATENT DOCUMENTS

| | | | |
|---|---|---|---|
| 5,182,600 | A | 1/1993 | Hasegawa et al. |
| 5,198,861 | A | 3/1993 | Hasegawa et al. |
| 5,327,196 | A | 7/1994 | Kato et al. |
| 5,387,965 | A | 2/1995 | Hasegawa et al. |
| 5,475,476 | A | 12/1995 | Murai et al. |
| 5,630,195 | A | 5/1997 | Sawayama et al. |
| 5,682,572 | A | 10/1997 | Murai et al. |
| 5,761,570 | A | 6/1998 | Sawayama et al. |
| 5,857,131 | A | 1/1999 | Hasegawa |
| 5,860,038 | A | 1/1999 | Kato et al. |
| 6,055,386 | A | 4/2000 | Kato et al. |
| 6,160,569 | A | 12/2000 | Fujimori et al. |

(Continued)

FOREIGN PATENT DOCUMENTS

| | | |
|---|---|---|
| JP | 04-060567 | 2/1992 |

(Continued)

OTHER PUBLICATIONS

U.S. Appl. No. 11/856,304, filed Sep. 17, 2007, Oshige, et al.

(Continued)

*Primary Examiner* — Hoan Tran
(74) *Attorney, Agent, or Firm* — Oblon, Spivak, McClelland, Maier & Neustadt, L.L.P.

(57) ABSTRACT

An image forming apparatus includes an image carrying member, an image forming mechanism, an optical sensor, and a controller. The image forming mechanism performs an image forming operation for forming a reference toner image on the image carrying member under a specific setting associated with the image forming mechanism. The optical sensor is arranged in a vicinity to the image carrying member. The controller performs an optical toner test for checking, by using the optical sensor, optical characteristics of the reference toner image formed on the image carrying member and to adjust the specific setting based on a result of the optical toner test.

18 Claims, 17 Drawing Sheets

U.S. PATENT DOCUMENTS

| | | | | |
|---|---|---|---|---|
| 6,496,677 | B2 | 12/2002 | Fujimori | |
| 6,526,235 | B2 | 2/2003 | Kato | |
| 6,594,453 | B2 | 7/2003 | Kato | |
| 7,711,275 | B2 * | 5/2010 | Miyashita | 399/37 |
| 2004/0136025 | A1 * | 7/2004 | Moriyama et al. | 358/1.14 |
| 2004/0253012 | A1 | 12/2004 | Ishibashi | |
| 2005/0019048 | A1 | 1/2005 | Kato | |
| 2005/0025510 | A1 * | 2/2005 | Yamada et al. | 399/49 |

FOREIGN PATENT DOCUMENTS

| | | | |
|---|---|---|---|
| JP | 06148991 | A * | 5/1994 |
| JP | 09-284556 | | 10/1997 |
| JP | 11-084762 | | 3/1999 |
| JP | 11-184187 | | 7/1999 |
| JP | 2000-075563 | | 3/2000 |
| JP | 2002-049193 | | 2/2002 |
| JP | 2002-148887 | | 5/2002 |
| JP | 2002-236402 | | 8/2002 |
| JP | 2003-131443 | | 5/2003 |
| JP | 2003-177589 | | 6/2003 |
| JP | 2005-77685 | | 3/2005 |
| JP | 2005-106525 | | 4/2005 |

OTHER PUBLICATIONS

U.S. Appl. No. 12/112,525, filed Apr. 30, 2008, Koizumi, et al.

U.S. Appl. No. 12/093,753, filed May 15, 2008, Oshige et al.

U.S. Appl. No. 12/094,198, filed May 19, 2008, Kato et al.

U.S. Appl. No. 11/952,553, filed Dec. 7, 2007, Tomita, et al.

Office Action issued Mar. 14, 2008, in Chinese Patent Application No. 2006101076268.

* cited by examiner

IMAGE FORMING APPARATUS CAPABLE OF REDUCING A LENGTHY DURATION OF AN ADJUSTMENT CONTROL

CROSS-REFERENCE TO RELATED APPLICATION

This patent specification is based on Japanese patent application, No. JPAP2005-215809 filed on Jul. 26, 2005 in the Japanese Patent Office, the entire contents of which are incorporated by reference herein.

BACKGROUND

1. Field of Invention

Exemplary aspects of the present invention relate to an apparatus for image forming, and more particularly to an apparatus for toner image forming capable of effectively controlling an image forming condition of an image forming mechanism for an adjustment at a predetermined timing.

2. Description of the Related Art

In general, related art image forming apparatus such as a copying machine, a printer, a facsimile machine, etc., employing an electrophotographic method, is provided with an image forming engine which is made based on a state-of-the-art technology involving different engineering fields, such as mechanical, electrical, and even chemical art. In many cases, the image forming engine is susceptible to changes, such as wear and tear of constituent components, conditions of power supply, and environmental factors, such as temperature and humidity, and so forth.

Therefore, the related art image forming apparatus is commonly provided with various adjustable parameters and is capable of adjusting these parameters to determine an image forming condition suitable for the image forming engine. The parameters may include a charge potential of a photoconductor, a development bias, a strength of optical writing relative to the photoconductor, and/or a target value of a toner density in a developer.

Such a parameter adjustment is typically performed when the background image forming apparatus is energized with power, or when it performs an image forming operation a predetermined cumulative number of times in units of sheet.

One exemplary parameter adjustment may optically measure an amount of reflection light relative to a surface of a photoconductor by using an optical sensor in two cases; no toner image is formed on the photoconductor surface and a reference toner image is formed on the photoconductor surface. A comparison is made on resultant reflection light amounts in the two cases. The comparison result can lead to an instant analysis of a toner density of the reference toner image on the photoconductor surface. Specifically, this process determines a toner amount of the reference toner image deposited in a unit area on the photoconductor surface. The determined toner amount becomes primary information based on which the parameter adjustment can be conducted.

As such, an output of the optical sensor is critical in the parameter adjustment. However, the optical sensor generally takes a relatively long time period to make an amount of light emission stable. FIG. 1 illustrates typical changes in an amount of light emission from one exemplary optical sensor at an initial power-on time. As shown in FIG. 1, this optical sensor needs several tens of a μsecond to make the amount of output light reach a maximal level. The emission amount, however, is gradually decreased as an internal resistance is increased with an increase in internal temperature of the optical sensor, and is stabilized when the increase in the internal temperature reaches a level of a saturation. In other words, an accurate reflection ratio of the light reflected by the reference toner image can only be detected after the optical sensor emits light in a stabilized manner, resulting in an undesirably lengthy duration of the parameter adjustment.

SUMMARY

An exemplary embodiment of the present invention provides an image forming apparatus including an image carrying member, an image forming mechanism, an optical sensor, and a controller. The image forming mechanism performs an image forming operation for forming a reference toner image on the image carrying member under a specific setting associated with the image forming mechanism. The optical sensor is arranged in a vicinity of the image carrying member. The controller performs an optical toner test for checking, by using the optical sensor, optical characteristics of the reference toner image formed on the image carrying member and to adjust the specific setting based on a result of the optical toner test.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein:

FIG. 9 is a graph illustrating a characteristic of a sensor output when a sensor output voltage is sufficiently stabilized, and then the gradation pattern image is detected after the LED of the optical sensor is turned on;

FIG. 10 is a graph illustrating a characteristic of the sensor output when the gradation pattern image is detected, and then the sensor output voltage is stabilized after the LED of the optical sensor is turned on;

FIG. 19 is a graph illustrating relationships among the toner adhesion amount of the reference patch, a ΔVsp and a ΔVsg, and a sensitivity correction coefficient a;

DETAILED DESCRIPTION OF THE EXEMPLARY EMBODIMENTS

Figure 1:
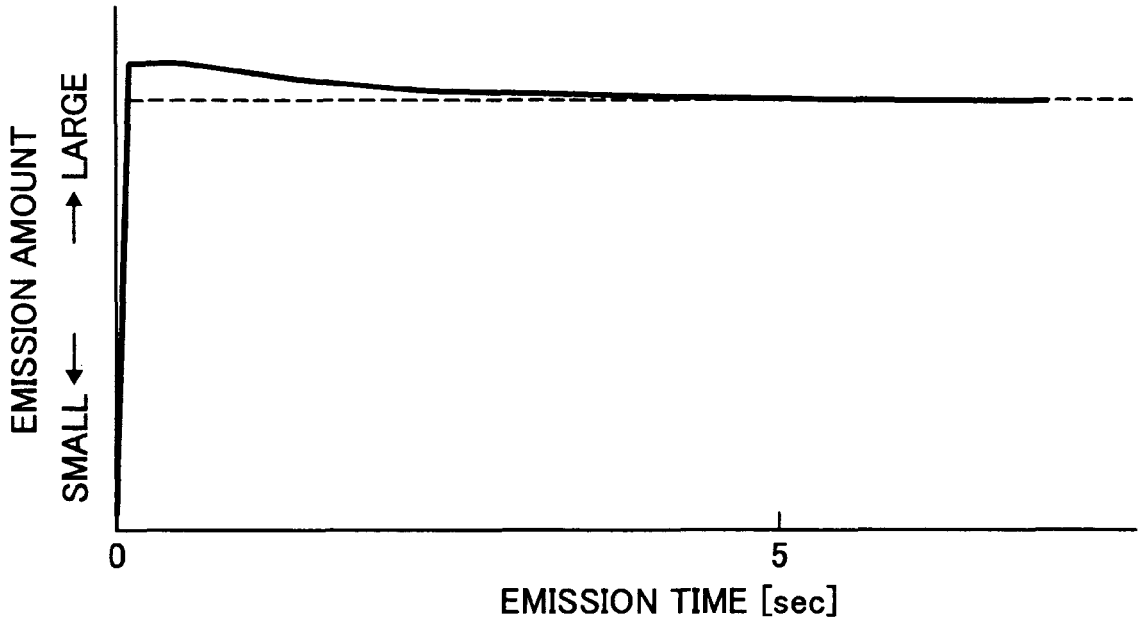
FIG. 1 BACKGROUND ART
FIG. 1 is a graph illustrating a characteristic of an emission in an early stage of a light emitting diode (LED) used in a background image forming apparatus.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, an image forming apparatus according to an exemplary embodiment of the present invention is described.

Figure 2:
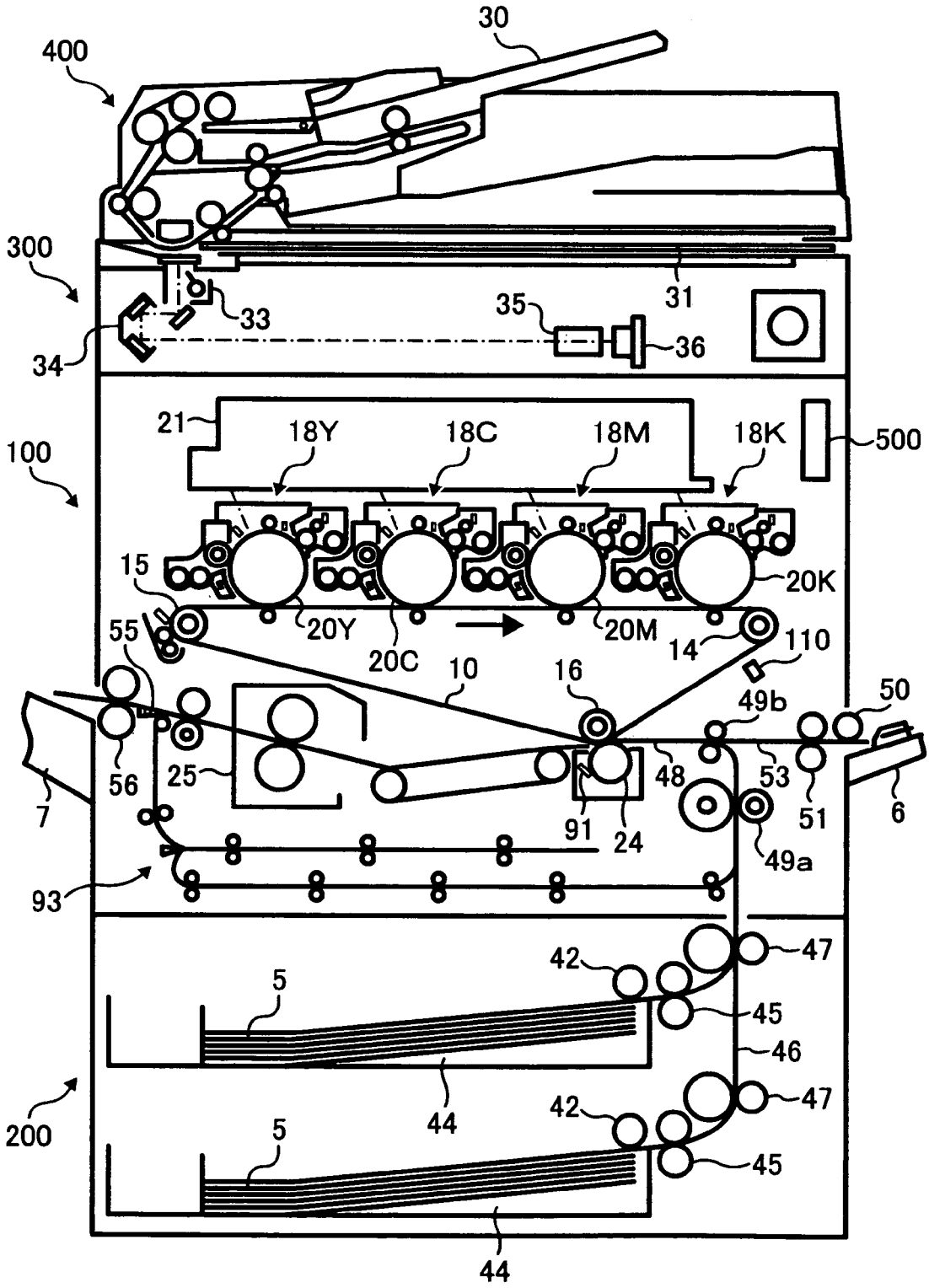
FIG. 2 is a schematic diagram of an image forming apparatus according to an exemplary embodiment.

Referring to FIG. 2, the image forming apparatus having a plurality of photoconductors called a tandem type includes a print unit 100, a feeding device 200, a scanner 300, an automatic document feeder (ADF) 400.

As illustrated in FIG. 2, the print unit 100 includes a main control unit 500, a manual feeding tray 6, an ejection tray 7, an intermediate transfer belt 10, a first support roller 14, a second support roller 15, and a third support roller 16, four image forming units 18Y, 18C, 18M, and 18K, a photoconductors 20Y, 20C, 20M, and 20K, a laser writing device 21, an optical sensor unit 110, a secondary transfer roller 24, a conveyance path 48, a conveyance roller 49*a*, a registration roller 49*b*, an ejection roller 56, a switching tab 55, a reversal device 93, a manual feeding path 53, a feed roller 50, a separation roller 51, a cleaning unit 91, and a fixing device 25.

The main control unit 500 controls a drive of a plurality of units, for example, the print unit 100, the feeding device 200, the scanner 300, and the ADF 400. A detailed description will be given with reference to FIG. 5. The manual feeding tray 6 is disposed so that a transfer sheet is supplied manually. The ejection tray 7 is on which the transfer sheet is ejected. The intermediate transfer belt 10 is an intermediate transfer member on which a toner image is transferred by the endless movement of a surface thereof. The first support roller 14, second support roller 15, and third support roller 16 lay across the intermediate transfer belt 10 in a tensioned condition, and are rotationally driven so that the transfer belt 10 is rotationally driven. The image forming units 18Y, 18C, 18M, and 18K include four drum photoconductors 20Y, 20C, 20M, and 20K respectively, and form electrostatic latent images onto the photoconductors 20Y, 20C, 20M, and 20K. Each of the four photoconductors 20Y, 20C, 20M, and 20K serves as a latent image carrier. Symbols Y, C, M, and K respectively indicate yellow, cyan, magenta, and black colors of toner. The laser writing device 21 emits a writing light by a laser so that latent images are formed on the photoconductors. The optical sensor unit 110 detects a density patch of a reference toner image formed onto the intermediate transfer belt 10. The secondary transfer roller 24 is a secondary transfer device used for a secondary transfer. The conveyance path 48 guides the transfer sheet to the ejection tray 7 through the secondary transfer roller 24. The conveyance roller 49*a* is used to convey the transfer sheet. The registration roller 49*b* registers the transfer sheet. The ejection roller 56 ejects the transfer sheet. The conveyance roller 49*a*, registration roller 49*b*, and ejection roller 56 are, for example, disposed along the conveyance path 48. The switching tab 55 disposed in a down stream side of the conveyance path 48 switches a conveyance direction of the transfer sheet to either the ejection tray 7 or the reversal device 93. The reversal device 93 reverses the transfer sheet so as to guide the transfer sheet to the secondary transfer roller 24 again. The manual feeding path 53 conveys the transfer sheet manually fed from the manual feeding tray 6 to the conveyance path 48. The feed roller 50 feeds the transfer sheets set in the manual feeding tray 6 one by one. The separation roller 51 separates the transfer sheets set in the manual feeding tray 6 one by one. The cleaning unit 91 cleans a toner adhered to the secondary transfer roller 24. The fixing device 25 fixes the toner image. A detailed description of the print unit 100 will be given with reference to FIGS. 3, 4, and 5.

The feeding device 200 includes a transfer sheet 5, a sheet cassette 44, a feed roller 42, a separation roller 45, a feeding path 46, and a conveyance roller 47.

The transfer sheet is a sheet of paper on which an image is formed by the image forming apparatus. The sheet cassette 44 stores the transfer sheet 5. The feed roller 42 and the separation roller 45 respectively feeds and separates the transfer sheet stored in the cassette 44 one by one. The feeding path 46 feeds the transfer sheet to the conveyance path 48. The conveyance roller 47 conveys the transfer sheet along the feeding path 46. A detailed description of the feeding device 200 will be given with reference to FIG. 5.

The scanner 300 includes a contact glass 31, a first traveling body 33, a second traveling body 34, an imaging lens 35, and a reading sensor 36.

The contact glass 31 is on which an original is placed. The first and second traveling bodies 33 and 34 scan the original. The imaging lens 35 focuses an image information. The reading sensor 36 reads the image information.

In the scanner 300, the original placed on the contact glass 31 is scanned by reciprocating the first and second traveling bodies 33 and 34 having a light source for illuminating the original and a mirror. The image information scanned by the traveling bodies 33 and 34 is focused at an imaging surface of the reading sensor 36 by the imaging lens 35 so that the reading sensor 36 may read the information as an image signal. A detailed description of the scanner 300 will be given with reference to FIG. 5.

The automatic document feeder (ADF) 400 includes an original tray 30 on which the original is placed instead of the contact glass 31. A detailed description of the ADF 400 will be given with reference to FIG. 5.

Figure 3:
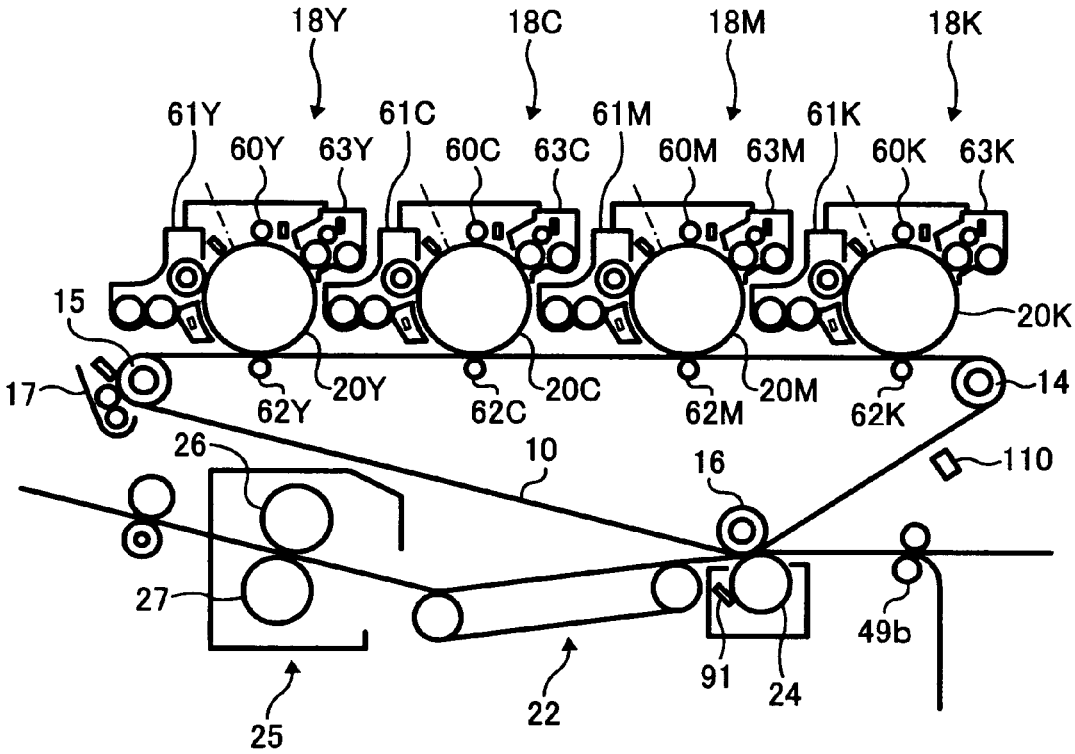
FIG. 3 is an enlarged diagram illustrating a vicinity of an intermediate transfer unit included in the image forming apparatus of FIG. 2.

Referring to FIG. 3, an enlarged diagram of the print unit 100 of FIG. 2 is illustrated. As illustrated in FIG. 3, a vicinity of the intermediate transfer belt 10 of the print unit 100 is similar to that of FIG. 2, except for a conveyance mechanism 22, a belt cleaning device 17, the fixing device 25, and the image forming unit 18. The fixing device 25 of FIG. 2 includes a heat roller 26 and a pressure roller 27 in FIG. 3. The image forming unit 18 of FIG. 2 includes a charging device 60, a development device 61, a primary transfer device 62, and a photoconductor cleaning device 63 in FIG. 3. For the charging device 60, development device 61, primary transfer device 62, and photoconductor cleaning device 63 included in the image forming unit 18, the symbols Y, C, M, and K respectively indicate yellow, cyan, magenta, and black. However, the color symbols are omitted as may be needed for explaining details of these devices below.

The conveyance mechanism 22 conveys the transfer sheet to the fixing device 25. The belt cleaning device 17 cleans the intermediate transfer belt 10. In the fixing device 25, the heat roller 26 heats the toner while the pressure roller 27 presses the toner on the transfer sheet to be fixed. The charging device 60 of the image forming unit 18 uniformly charges a surface of the photoconductor 20. The development device 61 develops the latent image so as to obtain a toner image. The primary transfer device 62 transfers the toner image on the photoconductor to the surface of the intermediate transfer belt 10. The photoconductor cleaning device 63 removes remaining toner from the photoconductor surface. Detailed descriptions of the charging device 60, development device 61, primary transfer device 62, and photoconductor cleaning device 63 will be given with reference to FIG. 4.

As shown in FIG. 3, the intermediate transfer belt 10 is laid across the support rollers 14, 15, and 16, and is rotationally driven in a clockwise direction. The intermediate transfer belt 10 is formed of a material, for example, a polyimide having a favorable mechanical characteristic of reducing an occurrence of a displacement caused by a stretch of the belt. This polyimide is dispersed with a carbon as an electric resistance adjustor so that a high quality image and high stabilization of a transfer capability are obtained without depending on a temperature and humidity. Thereby, the intermediate transfer belt is black.

The four image forming units 18Y, 18C, 18M, and 118K are disposed to a stretch portion of the belt between the first support roller 14 and the second support roller 15.

The optical sensor unit 110 is disposed to a stretch portion of the belt between the second support roller 15 and the third support roller 16. The laser writing device 21 of FIG. 2 is disposed above the four image forming units 18.

The laser writing device 21 drives a semiconductor laser (not shown) by a laser control unit (not shown) so as to emit the writing light based on the image information of the original read by the scanner 300. The writing light performs exposure scanning on the photoconductors 20Y, 20C, 20M, and 20K included in respective image forming units 18Y, 18C, 18M, and 18K so that the electrostatic latent images are formed on the photoconductors. A source of the writing light is not limited to a laser diode, and may include a light emitting diode (LED).

The secondary transfer roller 24 is disposed to a location opposed to the third support roller 16. When the toner image on the intermediate transfer belt 10 is secondarily transferred onto the transfer sheet 5, the secondary transfer roller 24 presses against a portion of the intermediate transfer belt 10 wound around the third support roller 16. Since the secondary transfer roller 24 may not be needed as the secondary transfer device, a transfer belt or a non-contact transfer charger, for example, may be employed as the secondary transfer device. The secondary transfer roller 24 is abutted on the cleaning unit 91.

The conveyance mechanism 22 is disposed in a down stream side in a conveyance direction of the transfer sheet 5 of the secondary transfer roller 24.

The fixing device 25 is disposed in a further down stream side. In the fixing device 25, the heat roller 26 and the pressure roller 27 press against each other.

The belt cleaning device 17 is disposed in a location opposed to the second support roller 15, and removes the remaining toner from the intermediate transfer belt 10 after the toner image on the intermediate transfer belt 10 is transferred onto the transfer sheet 5.

Figure 4:
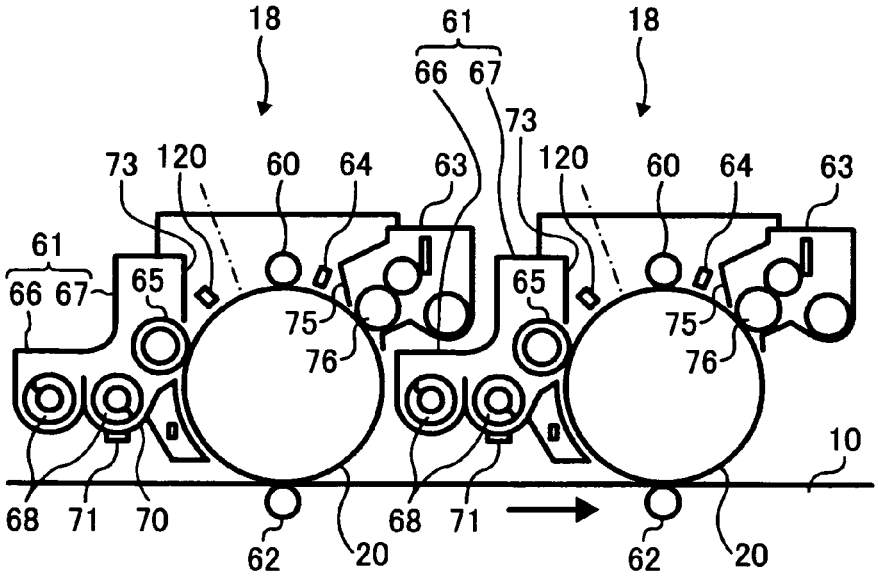
FIG. 4 is an enlarged diagram illustrating two image forming units among four image forming units included in the image forming apparatus of FIG. 2.

Referring to FIG. 4, an enlarged diagram illustrates two image forming units 18 among four units. As illustrated in FIG. 4, the two image forming units 18 are similar to those four units of FIG. 3, except for a discharge device 64, a potential sensor 120, the photoconductor cleaning device 63, the development device 61, and a development case 70. The photoconductor cleaning device 63 of FIG. 3 includes a cleaning blade 75 and a brush 76 in FIG. 4. The development device 61 of FIG. 3 includes an agitation unit 66 having two screws 68 and a development unit 67 having a development sleeve 65 and a blade 73 in FIG. 4. The color symbols Y, C, M, and K are omitted as may be need in a description as follows.

The discharge device 64 initializes a potential on the photoconductor surface. The potential sensor 120 detects the potential on the photoconductor surface. In the photoconductor cleaning device 63, the cleaning blade 75 and the brush 76 remove the toner from the photoconductor 20. In the development device 61, the agitation unit 66 conveys a two-component developer (hereafter called a developer) to the development sleeve 65 while agitating the developer. The two screws 68 included in the agitation unit 66 agitate the developer. The development unit 67 transfers the toner in the developer to the photoconductor 20 so as to form the toner image. The development sleeve 65 included in the development unit 67 acts as a developer carrier. The blade 73 included in the development unit 67 controls an amount of the developer at an appropriate level. The development case 70 is a case that houses, for example, the agitation unit 66 and development unit 67, and on which a density sensor 71 is attached. The density sensor 71 detects a toner density of the developer in the development device 61.

As shown in FIG. 4, the charging device 60, the development device 61, the photoconductor cleaning device 63, and the discharge device 64 are disposed in the vicinity of the photoconductor 20 of the image forming unit 18. The primary transfer device 62 is disposed to a location opposed to the photoconductor 20 through the intermediate transfer belt 10.

The charging device 60 uniformly charges the surface of the photoconductor by a voltage applied by contacting the photoconductor. The charging device 60 is a contact charging type using a charging, roller (not shown). However, a non-contact charging type, for example, using a non-contact scorotron charger may be employed as the charging device 60.

The development device 61 is divided into two units, the agitation unit 66 and the development unit 67.

The agitation unit 66 agitates the developer by the two screws 68 which are parallel to each other, and has a partition plate between the two screws such that both ends of the screws are in communication with each other. The agitated developer is supplied to the development sleeve 65. In this exemplary embodiment, the development device 61 uses the two-component developer including a magnetic carrier and a non-magnetic toner. However, a one-component developer may be used as the developer.

In the development unit 67 included in the development device 61, the developer supplied from the agitation unit 66 to the sleeve 65 is drawn to a sleeve surface by a magnetic force applied from a magnet roller (not shown) which is disposed in the sleeve 65. The drawn developer is conveyed with a rotation of the development sleeve 65 so as to be controlled by the blade 73 at the appropriate level. The developer controlled by the blade 73 is returned to the agitation unit 66. The blade 73 is disposed such that a tip thereof is in close proximity to the sleeve 65. A distance of a closest point between the blade 73 and the sleeve 65 is 0.35 mm in this exemplary embodiment. The developer conveyed to a development area opposed to the photoconductor 20 becomes in a chain shape by the magnetic force, and forms a magnetic brush. In the development area, a development electric field is formed by a development bias applied to the development sleeve 65 so that the toner in the developer is moved to an electrostatic latent image on the photoconductor 20. Thereby, the electrostatic latent image on the photoconductor 20 is visualized, and the toner image is formed. The developer passed the development area is conveyed to an area having a low magnetic field so as to be away from the development sleeve 65, and is returned to the agitation unit 66. When such operations are repetitively conducted, the toner density in the agitation unit 66 may be decreased. If so, the density sensor 71 detects the decreased density, and the toner is added to the agitation unit 66 based on a result detected by the sensor 71.

In the photoconductor cleaning device 63, the cleaning blade 75, for example, a polyurethane rubber blade is disposed such that a tip of the blade presses against the photoconductor 20. In the exemplary embodiment, the brush 76 is used in combination with the blade 75. The brush 76 is a dielectric brush, and contacts the photoconductor 20 to enhance a cleaning capability.

The discharge device 64 irradiates the photoconductor 20 with the light so as to initialize the potential on the photoconductor surface. The discharge device 64 may be a discharge lamp, for example.

The primary transfer device 62 is disposed so as to press against the photoconductor 20 through the intermediate transfer belt 10. A primary roller is employed as the primary transfer device 62. The transfer device 62 may be in various shapes, for example, a roller shape, and a brush shape with dielectric. The transfer device 62 may employ a charger, for example, a non-contact corona charger.

In the image forming unit 18, the potential sensor 120 is disposed in a location opposed to the photoconductor 20. The photoconductor 20 is in a drum shape having a diameter of 60 mm, and is rotationally driven at a linear velocity of 282 mm/sec. The development sleeve 65 is in a cylindrical shape having a diameter of 25 mm, and is rotationally driven at the linear velocity of 564 mm/sec. A charging amount of the toner in the developer supplied to the development area has a suitable range from −10 to −31 μC/g. The photoconductor 20 and the development sleeve 65 has a development gap between them. The development gap is set at a range from 0.5 to 0.3 mm, and a development efficiency may be enhanced as the gap becomes smaller. The photoconductor 20 has a photoconductor layer which has a thickness of 30 μm. The laser writing device 21 emits an optical laser beam which has a spot diameter of 50×60 μm and a light amount of 0.47 mW.

The photoconductor surface is uniformly charged by the charging device 60 with −700V, for example. The potential on the electrostatic latent image irradiated with the laser from the laser writing device 21 becomes −120V, for example. A voltage of the development bias is set to be −470V, and the development potential of 350V is obtained. Such a process condition may be modified as may be needed depending on a result of a potential control.

Therefore, in the photoconductor 18, the charging device 60 uniformly charges the surface of the photoconductor 20 with rotation of the photoconductor 20. The laser writing device 21 irradiates the photoconductor with the writing light based on the image information read by the scanner 300 so that the electrostatic latent image is formed on the photoconductor. The development device 61 visualizes the latent image so as to form the toner image. The primary transfer device 62 primarily transfers the toner image onto the intermediate transfer belt 10. The photoconductor cleaning device 63 removes the remaining toner on the photoconductor surface after the primary transfer, and the discharge device 64 discharges the photoconductor surface for forming a next image.

Figure 5:
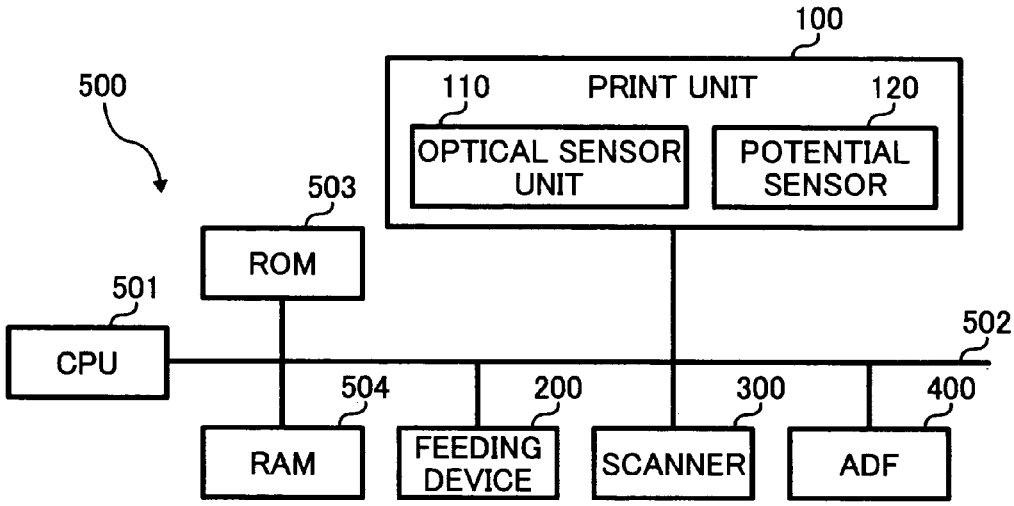
FIG. 5 is a block diagram illustrating a substantial portion of an electric circuit included in the image forming apparatus of FIG. 2.

Referring to FIG. 5, an electric circuit in the image forming apparatus of the exemplary embodiment is illustrated. The electric circuit includes the main control unit 500 which controls a drive of a plurality of units. The main control unit 500 includes a central processing unit (CPU) 501, a read only memory (ROM) 503, and a random access memory (RAM) 504.

The CPU 501 executes various computations or driving controls of the plurality of units. The ROM 503 stores fixed data beforehand, for example, a computer program. The ROM 503 also stores a conversion table (not shown) having conversion information on the per unit area of the toner adhesion amount with respect to an output amount of the optical sensor unit 110. The RAM 504 functions as an work area, for example, rewriting and freely storing various data.

As shown in FIG. 5, the CPU 501, ROM 503, and RAM 504 of the main control unit 500 are connected through a bus line 502. The main control unit 500 is connected to the plurality of units including the print unit 100, the feeding device 200, the scanner 300, and the ADF 400 through the bus line 502. The main control unit 500 is sent information detected by the optical sensor unit 110 of FIG. 3 and the potential sensor 120 of FIG. 4 included in the print unit 100.

When an original is copied by the image forming apparatus of this example embodiment, the original is placed on the original tray 30 of the ADF 400, or is placed on the contact glass 31 of the scanner 300 by opening the ADF 400. The original on the contact glass 31 is pressed by closing the ADF 400. When a user presses a start switch (not shown), the original placed on the tray 30 is conveyed on the contact glass 31, and the scanner 300 is driven so that the first and second traveling bodies begin scanning. A light from the first traveling body 33 is reflected at the original on the contact glass 31, which is then reflected by a mirror of the second traveling body 34. The light is guided to the reading sensor 36 through the imaging lens 35 so that image information of the original is read.

When the user presses the start switch, a drive motor (not shown) is driven, and one of the support rollers 14, 15, and 16 is rotationally driven so that the intermediate transfer belt 10 is rotationally driven. Simultaneously, the photoconductors 20Y, 20C, 20M, and 20K of the respective image forming units 18Y, 18C, 18M, and 18K are rotationally driven. The laser writing device 21 irradiates the photoconductors 20 of the image forming units 18 with the writing light based on the image information read by the reading sensor 36. The electrostatic latent images are formed on the photoconductors 20, and are visualized by the development devices 61. Thereby, toner images of yellow, cyan, magenta, and black are formed on the respective photoconductors 20Y, 20C, 20M, and 20K.

These color toner images formed on the photoconductors 20Y, 20C, 20M, and 20K are sequentially transferred onto the transfer belt 10 by the primary transfer devices 62Y, 62C, 62M, and 62K such that the color images are superimposed on the belt 10. Thereby, synthetic toner images are formed on the intermediate transfer belt 10 by superimposing the color images. The remaining toner on the intermediate transfer belt 10 is removed by the belt cleaning device 17 after the secondary transfer.

When the user presses the start switch, the feed roller 42 of the feeding device 200 corresponding to the transfer sheet 5 selected by the user is rotated, and the transfer sheets 5 are fed from one of the sheet cassettes 44. The transfer sheets fed from the cassette are separated to one sheet by the separation roller 45, and each sheet is fed into the feeding path 46. Each transfer sheet 5 is conveyed to the conveyance path 48 by the conveyance roller 47, and is stopped at the registration roller 49*b*.

The registration roller 49*b* begins to rotate at a timing when the synthetic toner images on the intermediate transfer belt 10 is conveyed to a secondary transfer area opposing to the secondary transfer roller 24. The transfer sheet 5 is fed from the registration roller 49*b*to a location between the intermediate transfer belt 10 and the secondary transfer roller 24, and the synthetic toner image on the transfer belt 10 is secondarily transferred onto the transfer sheet 5. The transfer sheet 5 is conveyed to the fixing device 25 while being absorbed to the secondary transfer roller 24, and is heated and pressed by the fixing device 25 so that the toner image is fixed. The transfer sheet 5 is ejected to the ejection tray 7 by the ejection roller 56. In a case where an image is formed on a back side of the transfer sheet having a fixed toner image, the transfer sheet passed the fixing device 25 is switched in a conveyance direction thereof by the switching tab 55, and is fed to the reversal device 93. The sheet 5 is reversed by the reversal device 93, and is guided to the secondary transfer roller 24 again.

The control unit 500 of the image forming apparatus having the CPU 501, ROM 503, and RAM 504 performs an adjustment control of an image forming condition called a self-check immediately after a power source (not shown) is turned on. In the self-check, gradation pattern images are formed on the surfaces of the photoconductors 20Y, 20M, 20C, and 20K in the respective image forming units 18Y, 18C, 18M, and 18K, and are transferred onto the intermediate transfer belt 10. The gradation pattern images of yellow, magenta, cyan, and black include a plurality of reference patches (e.g., reference toner images) each of which has a per unit area of the different toner adhesion amount. These gradation pattern images are transferred on the transfer belt 10. A detailed description of the gradation pattern images and the reference patch will be given with reference to FIG. 6.

Figure 6:
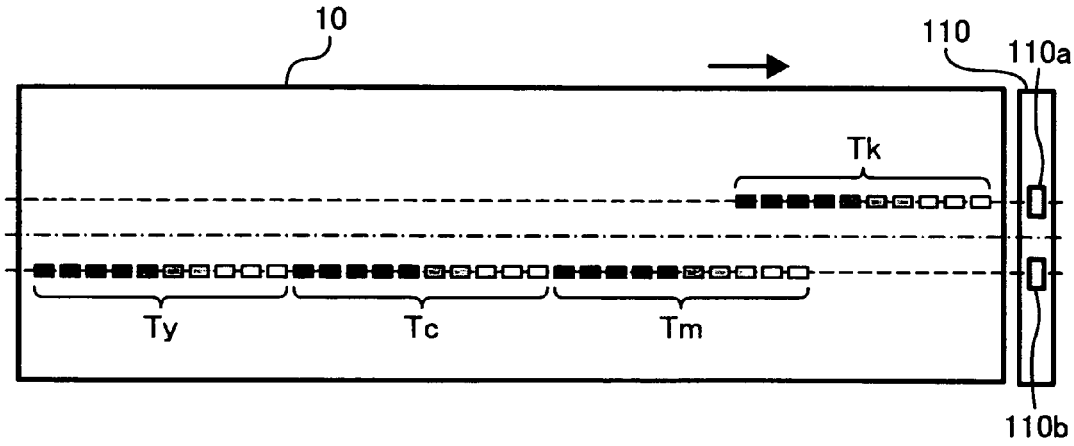
FIG. 6 is a schematic diagram of the intermediate transfer belt and a gradation pattern image formed on a surface thereof included in the image forming apparatus of FIG. 2.

Referring to FIG. 6, the gradation pattern images formed on the intermediate transfer belt 10 is illustrated. The gradation pattern images includes an M gradation pattern image Tm, a C gradation pattern image Tc, a Y gradation pattern image Ty, and a K gradation pattern image Tk. The M gradation pattern image Tm includes a plurality of M reference patches. Each of the M reference patches has a different density. The C, Y, and K gradation pattern images Tc, Ty, and Tk include a plurality of C, Y, and K respective reference patches each of which has the different density. The M, C, and Y gradation pattern images Tm, Tc, and Ty are sequentially transferred in a belt movement direction such that the gradation pattern images are aligned. The K gradation pattern image Tk, on the other hand, is transferred in another location in a belt width direction as shown in FIG. 6.

Figure 7:
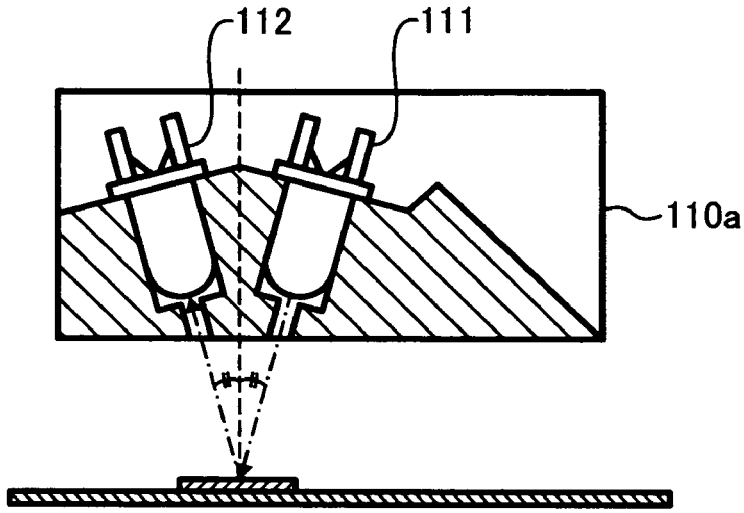
FIG. 7 is an enlarged diagram of a regular reflection optical sensor in an optical sensor unit included in the image forming apparatus of FIG. 2.
Figure 8:
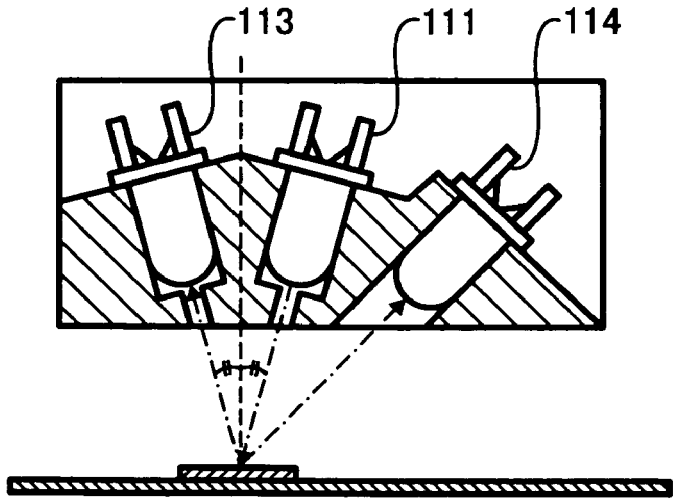
FIG. 8 is an enlarged diagram of a multi-reflection optical sensor in the optical sensor unit included in the image forming apparatus of FIG. 2.

The optical sensor unit 110 described above includes a regular optical sensor 110*a* and a multi-reflection sensor 110*b* which are respectively described in FIG. 7 and FIG. 8.

Referring to FIG. 7, the regular optical sensor 110*a* includes an emission mechanism 111 and a receiving mechanism 112. The emission mechanism 111 is the LED, and the receiving mechanism 112 is a light receiving element. The regular optical sensor 110*a* emits a light from the emission mechanism 111 towards the surface of the intermediate transfer belt 10. The receiving mechanism 112 receives a regular reflection light reflected by the surface of the intermediate transfer belt 10 or by the reference patches transferred onto the surface of the belt 10 so that a voltage corresponding to an amount of the received light is output.

Referring to FIG. 8, the multi-reflection sensor 110*b* includes the emission mechanism 111 (e.g. the LED), a first receiving element 113, and a second receiving element 114. The emission mechanism 111 acts similar to that of FIG. 7. The first receiving element 113 receives the regular refection light. The second receiving element 114 receives a diffuse reflection light. The multi-reflection sensor 110*b* emits the light from the emission mechanism 111 towards the surface of the intermediate transfer belt 10. The first receiving element 113 receives the regular reflection light reflected by the surface of the intermediate transfer belt 10 or by the reference patches transferred onto the surface of the belt 10 so that the voltage corresponding to an amount of the received light is output. The second receiving element 114 receives the diffuse reflection light diffused by the intermediate transfer belt 10 or by the reference patches transferred onto the surface of the belt 10 so that the voltage corresponding to an amount of the received light is output.

Therefore, the regular optical sensor 110*a* of FIG. 7 detects each K reference patch of the K gradation pattern image Tk transferred onto the intermediate transfer belt 10, and outputs the voltage corresponding to the toner adhesion amount in the each patch. The multi-reflection sensor 110*b* of FIG. 8 detects each M reference patch of the M gradation pattern image Tm, each C reference patch of the C gradation pattern image Tc, and each Y reference patch of the Y gradation pattern image Ty transferred onto the intermediate transfer belt 10, and outputs the voltage corresponding to the adhesion amount in the each patch. The regular optical sensor 110*a* and multi-reflection sensor 110*b* are hereafter generically called the optical sensor.

The optical sensor employs a GaAs infrared emission diode with a peak emission wavelength $\lambda p=950$ nm as the LED. The optical sensor also employs a Si phototransistor of 800 nm of a peak receiving sensitivity as the light receiving element. A detection distance between the optical sensor and a detection target surface of the intermediate transfer belt 10 is 5 mm.

Regarding the self-check described in FIG. 5, the image density is stabilized by adjusting the image forming conditions based on the output voltage corresponding to each reference patch (see FIGS. 7 and 8). The self-check includes a Vsg adjustment, a potential adjustment, and a half-tone γ correction. The Vsg adjustment adjusts the emission amount from the LED such that the output voltage from the optical sensor by which a background unit (e.g., a surface without toner adhesion) of the intermediate transfer belt 10 is detected becomes a predetermined value (e.g., 4.0±0.2V). The potential adjustment detects the each reference patch in the gradation pattern image (e.g., a 10-gradation pattern) formed onto the transfer belt 10 by the optical sensor, and calculates an appropriate development γ based on the output voltage corresponding to the each reference patch. A photoconductor uniform charge potential, a development bias, and an optical writing intensity capable of obtaining a target image density are specified based on a result calculated by the potential adjustment, and each of these is set to be a setting value. The half-tone γ correction detects the each reference patch in the gradation pattern image (e.g., a 16-gradation pattern) formed onto the intermediate transfer belt 10 by the optical sensor. The γ correction corrects each optical writing γ being the setting value of the optical writing intensity corresponding to each gradation based on a deviation amount between the output voltage corresponding to each reference patch and a target gradation characteristic to target. Thereby, a target gradation characteristic is obtained. The development γ refers to a gradient of a graph indicating a relationship between the development potential and the per unit area of the toner adhesion amount. The development potential refers to a potential difference between the electrostatic latent image of the photoconductor surface and a development sleeve surface to which the development bias is applied.

The LED of the optical sensor has the characteristic described in FIG. 1 of the related art. When the LED begins emitting a light, a waiting time of 3 to 5 seconds is needed to detect the light reflection amount. In a case where the waiting time is obtained without reducing a throughput within a print job in process, an occurrence of a user dissatisfaction may be reduced. However, in a case where the waiting time causes an interruption of the print job, or an extension of a time to begin the print job, the user may be stressed having to wait.

This waiting time of the related art may be eliminated when one reference patch is formed, and is detected by the optical sensor. For example, the waiting time may be eliminated when one patch is formed in an area between transfer sheets of a printing job in execution even if an initial change in the emission amount of the LED exists. For example, the Vsg is detected immediately before the reference patch is detected so that substantially no influence is exerted on a detection accuracy of the Vsg and the reference patch because results of these detections are derived from relatively the same emission amounts. However, such a control may not be conducted when the self-check is performed. A detailed description will be given with reference to FIGS. 9 through 11.

Figure 9:
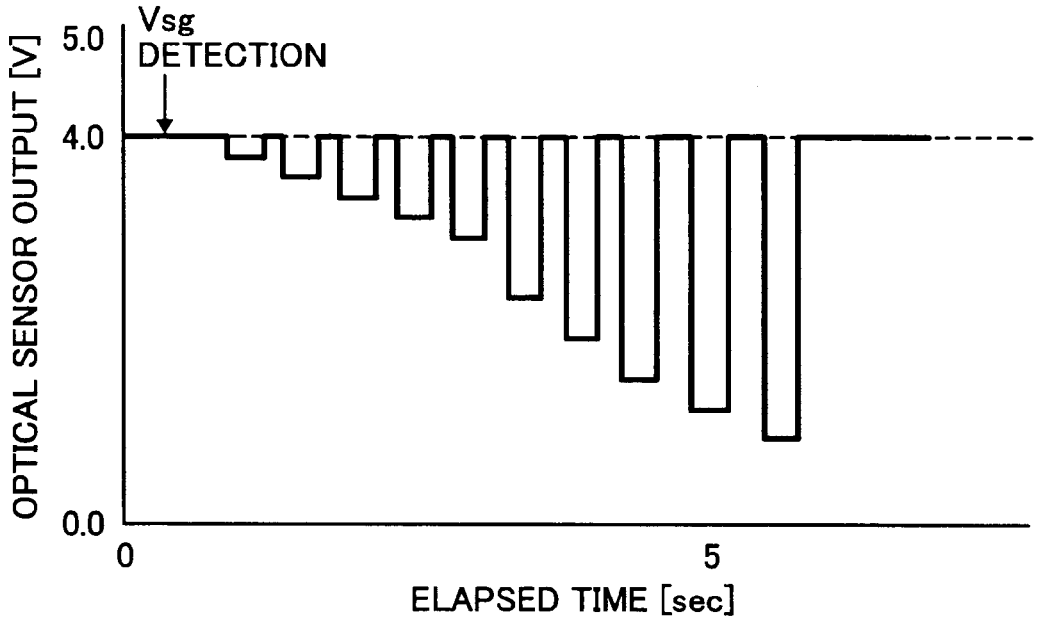
Figure 10:
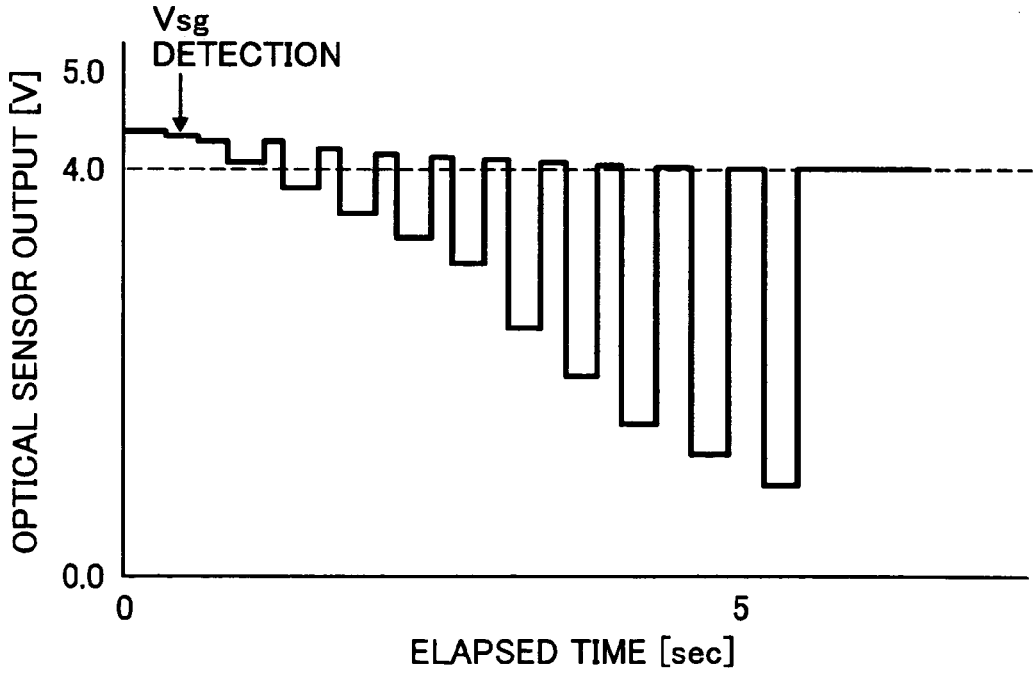

Referring to FIGS. 9 and 10, graphs illustrate example cases where gradation pattern images including 10 reference patches are detected. Each of the 10 reference patches has a per unit area of the different toner adhesion amount which increases gradually within the 10 patches.

In FIG. 9, the graph illustrates a characteristic of a sensor output when a sensor output voltage value (e.g., the emission amount of the LED) is sufficiently stabilized, and then the gradation pattern is detected after the LED of the optical sensor is turned on. As shown in FIG. 9, the toner amounts of the 10 reference patches are properly detected.

In FIG. 10, the graph illustrates a characteristic of the sensor output when the gradation pattern is detected without stabilizing the sensor output voltage value beforehand after the LED of the optical sensor is turned on. As shown in FIG. 10, the toner amounts of the first 6 reference patches are not properly detected.

Figure 11:
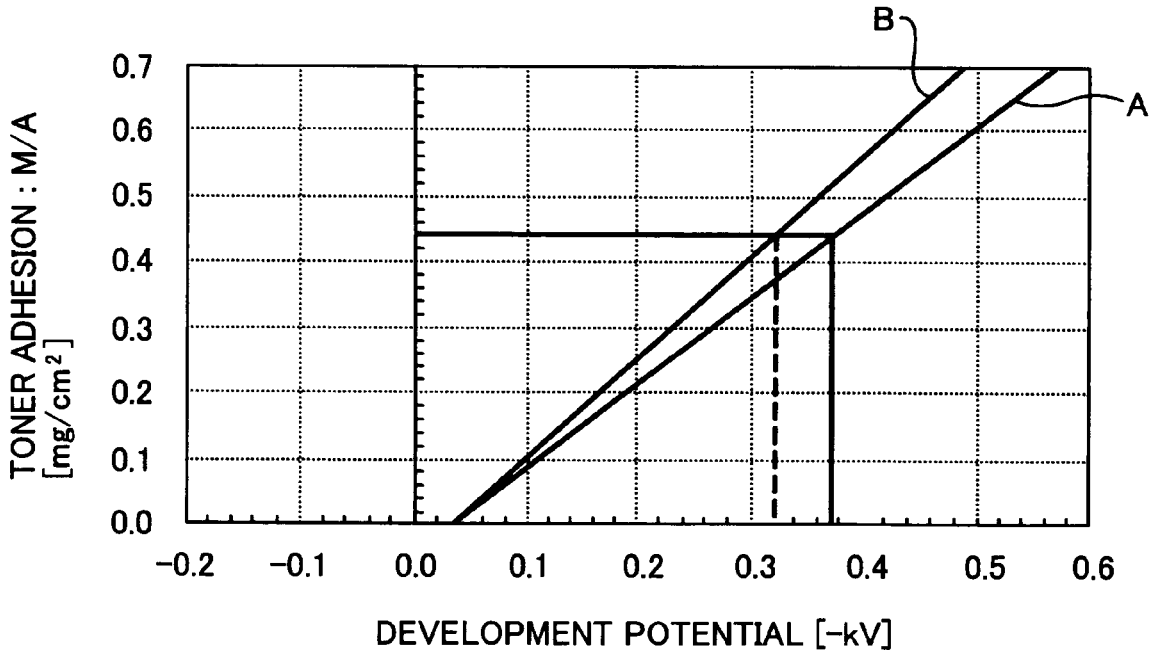
FIG. 11 is a graph illustrating characteristics of a development y which is specified based on a detection result of the gradation pattern image.

Differences between results of FIGS. 9 and 10 are described in FIG. 11.

Referring to FIG. 1, a graph illustrates characteristics of a development γ which is specified based on the detection results of the each gradation pattern image. The graph shows a relationship between a horizontal axis indicating the development potential when the gradation pattern image is formed and a vertical axis indicating the toner adhesion amount. This toner adhesion amount is a converted value of a result of the gradation pattern image detected by the optical sensor. A line A indicates the development γ when the gradation pattern image is detected after the sensor output value is stabilized. A line B indicates the development γ when the gradation pattern image is detected without stabilizing the sensor output value. As shown in the graph, an error is generated between the two lines of the developments γ. Therefore, when the gradation pattern image is detected without stabilizing the sensor output value, the development potential needed for obtaining a target toner adhesion amount is calculated below an appropriate level. The image density of a post self-check is controlled below a target image density. Such an inconvenience occurs when the gradation pattern image is detected. Thereby, the waiting time is needed to stabilize the emission amount of the LED.

In the related art, the LED of the optical sensor is turned on and off each time the Vsg adjustment, potential adjustment, and half-tone γ correction for the self-check are performed. For example, a sum of the waiting time has been 5 seconds×3 times=15 seconds.

A configuration of the image forming apparatus of the exemplary embodiment is described below.

Figure 12:
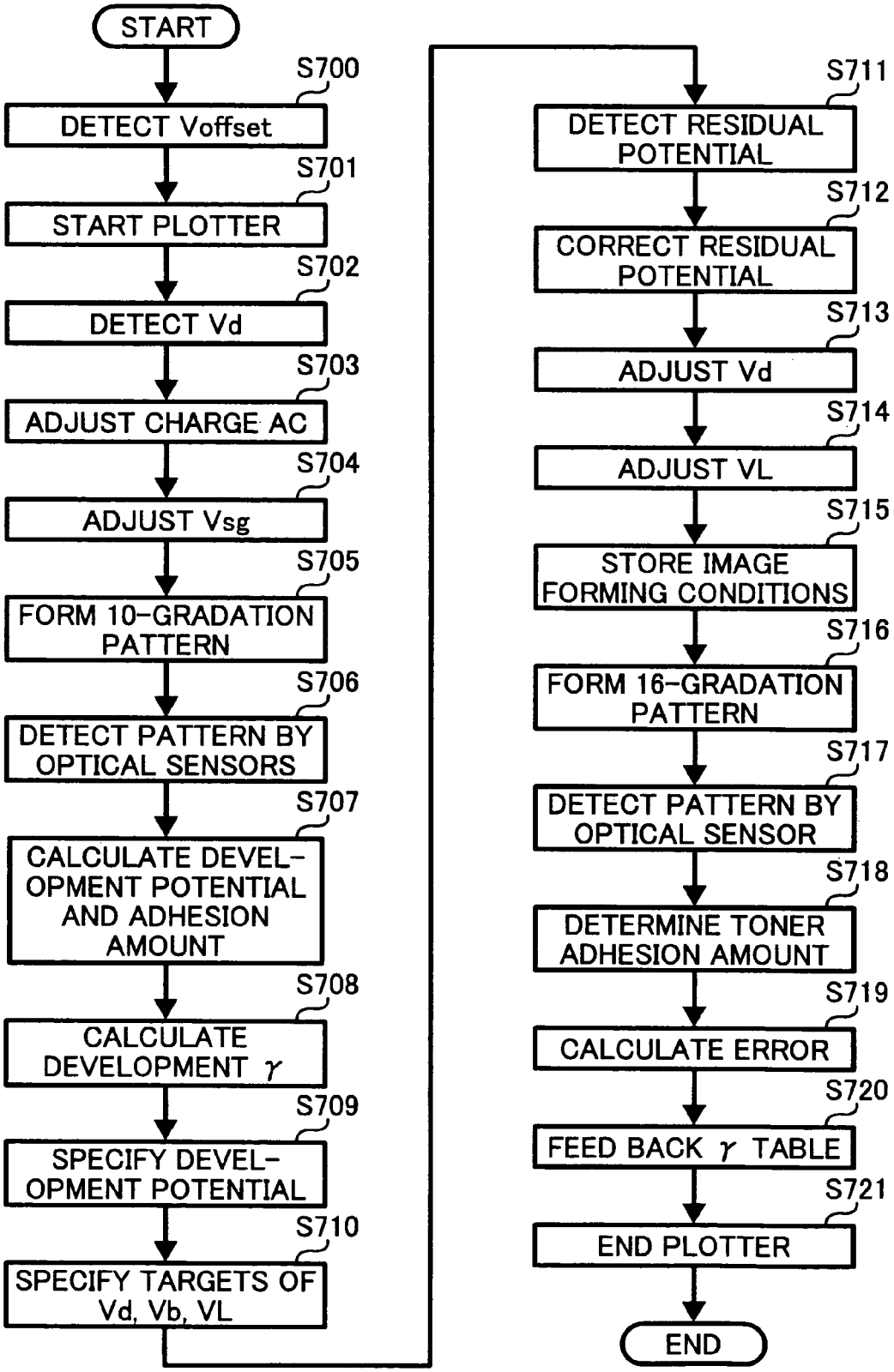
FIG. 12 is a flowchart for explaining an example control procedure of a self-check by a control unit included in the image forming apparatus of FIG. 2.

Referring to FIG. 12, a flowchart illustrates an example control procedure of the self-check performed by the image forming apparatus. The self-check is performed immediately after a power source (not shown) of the image forming apparatus is activated. Particularly, a surface temperature of the fixing roller in the fixing device 25 is detected so that a state when the power source is activated may be distinguished from an abnormal process, for example, a jam. A detection result is determined whether or not the surface temperature is above 100° C. When the surface is above 100° C., the self-check is not performed. When the surface is below 100° C., the self-check is performed. Thereby, in the image forming apparatus, the control unit 500 determines whether or not a condition which the surface temperature is not above 100° C. immediately after activation of the power source is included. When the condition is satisfied, the self-check is performed.

In the self-check procedure, in a step S700, output voltages for the two optical sensors in states where the LEDs are OFF are detected as Voffset. For the regular optical sensor 110*a*, the output voltage from the light receiving element 112 is detected as a Voffset_reg. For the multi-reflection sensor 110*b*, the output voltage from the first receiving element 113 is detected as the Voffset_reg while the output voltage from the second receiving element 114 is detected as a Voffset_dif.

In a step S701, a start process of an image forming apparatus is performed. A motor load is started, for example, each photoconductor motor, an intermediate transfer belt motor, and a secondary transfer motor. Also, a charge bias, a development bias and a transfer bias are started at predetermined image forming timings. Here, the intermediate transfer belt motor is started so that the intermediate transfer belt 10 begins to drive, and simultaneously the LED of the optical sensor is turned on. Start timings of the motors, biases, and LED are described in FIG. 13.

In a step S702, a surface potential Vd of the each photoconductor 20 uniformly charged under a predetermined condition is detected by the potential sensor 120.

In a step S703, an AC charge bias of the charging device 60 is adjusted based on a result detected by the step 702. In steps S702 and S703, procedures are performed in parallel by respective colors of the photoconductor units 18Y, 18C, 18M, and 18K.

In a step S704, the Vsg adjustment described above is performed. The emission amount of the LED of the optical sensor 110*a* is adjusted such that the output voltage Voffset_reg from the regular optical sensor 110*a* detecting the regular reflection light from the background unit of the intermediate transfer belt 10 is to be within a predetermined range (e.g., 4.0±0.2V). Each output voltage after the adjustment is stored in the RAM 504 as the Voffset_reg or the Voffset_dif. In the step S704, a procedure is performed for two optical sensors in parallel.

The steps S702 through S704 are called pre-processing. After the pre-processing, the potential adjustment is performed in steps S705 through S715.

In the step S705, four 10-gradation pattern images are formed for colors, Y, C, M, and K. Each 10-gradation pattern image includes 10 reference patches of different densities with different toner adhesion amounts.

In a step S706, the gradation pattern images are detected by the two optical sensors which are disposed 40 mm away from each other, and respective results are stored in the RAM 504 as K-Vsp_reg-i, Y-Vsp_dif-i, C-Vsp_dif-i, M-Vsp_dif-I where i is 1 through 10. Simultaneously, the output value of the potential sensor 120 with respect to a potential of each gradation pattern image on the photoconductor 20 is read and stored in the RAM 504. Each reference patch is sized at 15 mm×20 mm, and is disposed 10 mm away from one another.

Figure 14:
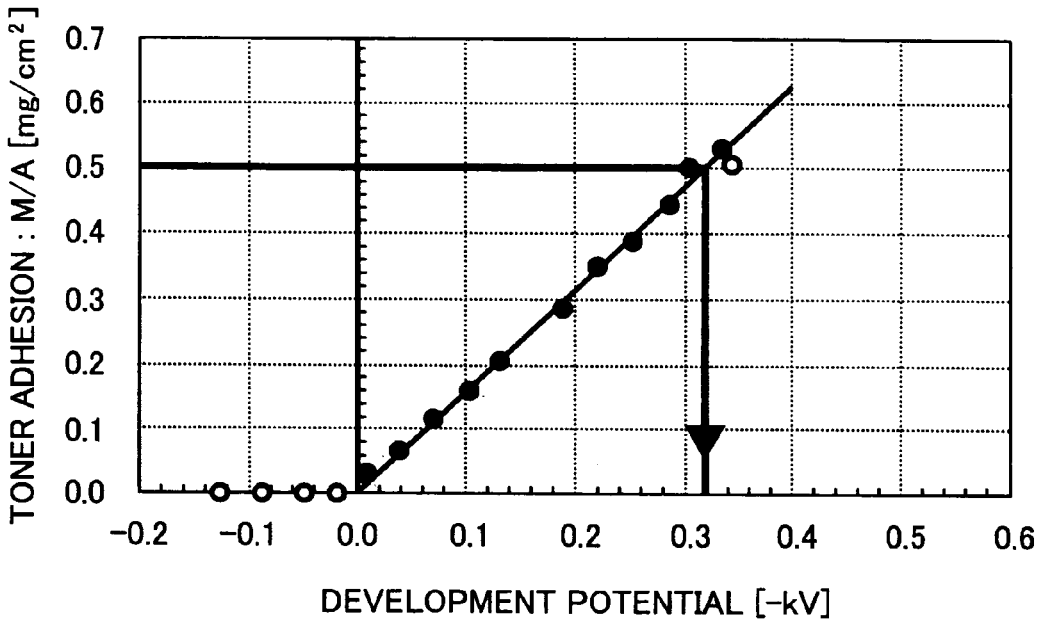
FIG. 14 is a graph illustrating a relationship between a development potential and a toner adhesion amount of a reference patch.

In a step S707, the development potential is calculated from the output value of the potential sensor 120 stored in the RAM 504, and the development bias at a time of forming the pattern (see, FIG. 14). Simultaneously, the toner adhesion amount of the each patch is calculated based on a calculation algorithm for a predetermined adhesion amount. This calculation algorithm uses different toner adhesion amounts for the K toner and the color toners of Y, C, and M. For the adhesion amount for the K toner, an output ratio (Vsp/Vsg) of the output of the belt background unit (Vsp) to the output of a reference patch portion (Vsg) is calculated, and a conversion table for the adhesion amount (not shown) stored in the ROM is referred to determine the amount. A calculation for the adhesion amounts for the color toners will be described later.

In a step S708, the development γ is calculated by calculating an equation of a collinear approximation (shown in FIG. 14). In the equation, a gradient is called the development γ, and an intercept is called a development start voltage. In a step S709, the development potential needed for obtaining the target toner adhesion amount is specified based on the development potential γ.

In a step S710, the charge potential Vd of the photoconductor 20 (i.e., the surface potention of the photoconductor), the development bias Vb, an optical writing intensity VL matching to the development potential γ are specified based on a potential table, for example TABLE 1 below.

TABLE 1

| No. | Potential | Vd | Vb | VL |
|---|---|---|---|---|
| 1 | 168 | 391 | 261 | 102 |
| 2 | 183 | 414 | 280 | 108 |
| 3 | 198 | 438 | 299 | 114 |
| 4 | 213 | 461 | 318 | 120 |
| 5 | 228 | 484 | 337 | 125 |
| . | . | . | . | . |
| . | . | . | . | . |
| . | . | . | . | . |
| 16 | 393 | 737 | 544 | 190 |
| 17 | 408 | 760 | 563 | 195 |
| 18 | 423 | 783 | 582 | 201 |
| 19 | 438 | 806 | 600 | 207 |
| 20 | 453 | 829 | 619 | 213 |

In a step S711, a laser emission power of a semiconductor laser is controlled through a laser control circuit (not shown) controlling the laser writing device 21 so as to be a maximal light amount, and a residual potential of the photoconductor 20 is detected by importing the output value of the potential sensor 120.

In a step S712, when the residual potential of the step S711 is not 0, the residual potential is corrected with respect to the Vd, Vb, and VL specified in the step S710 so as to be as a target potential.

In a step S713, a power circuit (not shown) is adjusted such that the charge potential Vd by the charge device 60 of the each photoconductor 20 becomes the target potential.

In a step S714, the optical writing intensity VL is adjusted so that the laser emission power of the semiconductor laser through the laser control circuit is adjusted such that the surface potential Vd of the photoconductor 20 becomes the target potential.

In a step S715, after the power circuit is adjusted such that the respective development bias potentials Vt of the development devices 61K, 61C, 61M, 61Y become the target potentials, respective adjusted values are stored as image forming conditions in a printing operation.

After the potential adjustment in the steps S705 through S715, the γ correction is performed in steps S716 through S720.

In the step S716, a 16-gradation pattern image is formed for each color.

In a step S717, the 16-gradation pattern image is detected on the intermediate transfer belt 10 by the optical sensor.

In a step S718, the toner adhesion amount of each reference patch is determined based on a result of the step S717.

In a step S719, data of the toner adhesion amount as a half-tone correction is plotted with respect to a LD (laser diode) writing amount. An amount of the error with respect to an ideal half-tone characteristic is calculated based on a result of the plot.

In a step S720, a correction is made with respect to an input value of the each LD writing amount, and a result of the correction (e.g., a process control γ table) is fed back to an optical writing γ. Process operations of the self-check are ended in the step S720.

In a step S721, an ending process of the image forming apparatus is performed, and the self-check is ended. Here, the LED of the optical sensor is turned off.

A series of the self-check includes noteworthy points. When the start process of the image forming apparatus is performed, the intermediate transfer belt 10 begins to drive, and simultaneously the LEDs of the two optical sensors are turned on. The LEDs of the optical sensors remain being on until the ending process of the image forming apparatus is performed. The start process of the image forming apparatus needs 2 seconds for stabilizing a driving speed of each driving unit or the output voltage value of the power circuit, for example. After the image forming apparatus is started, various processes are needed before the Vsg is detected. The various processes include, for example, a detection of the Vd (S702) and an adjustment of the AC charge (S703). While these processes need at least several seconds to complete, the emission amount of the LED may be stabilized. Thereby, a necessity of the waiting time for stabilizing the emission amount of the LED is reduced in the step S704. An occurrence of prolonging the self-check may be reduced.

In the image forming apparatus of the exemplary embodiment, once the image forming apparatus is started, the LED remains on until the image forming apparatus is finished. Unlike the device of the related art which turns the LED on and off each time the gradation pattern image is detected, this image forming apparatus may not be in need of the waiting time for the potential adjustment and the half-tone γ correction. Thereby, an occurrence of a lengthy duration of the self-check by the waiting time may be reduced.

An ideal detection location for accurately feeding back the detection result of the reference patch has generally been known on the photoconductor which is after the development and before the transfer. However, when the reference patch is detected on the photoconductor, a light fatigue of the photoconductor is generated by irradiation of a LED light. This fatigue of the photoconductor has generated situations, for example, an image formed on a LED (a light emitting diode) irradiated portion of the photoconductor has been darker or faded in a stripe shape. Consequently, the LED is on for a minimum period of a time so that an occurrence of the fatigue is reduced. Unlike a configuration of the image forming apparatus of the exemplary embodiment, the related art is not capable of employing a configuration in which the LED is turned on as early as possible so that and the emission amount is stabilized beforehand.

In the image forming apparatus, each reference patch is detected on the intermediate transfer belt 10, rather than on the photoconductor. In the configuration of the image forming apparatus, the LED is turned on at an early timing, and an occurrence of prolonging the self-check may be reduced without the light fatigue of the photoconductor by irradiation of the LED light.

Figure 13:
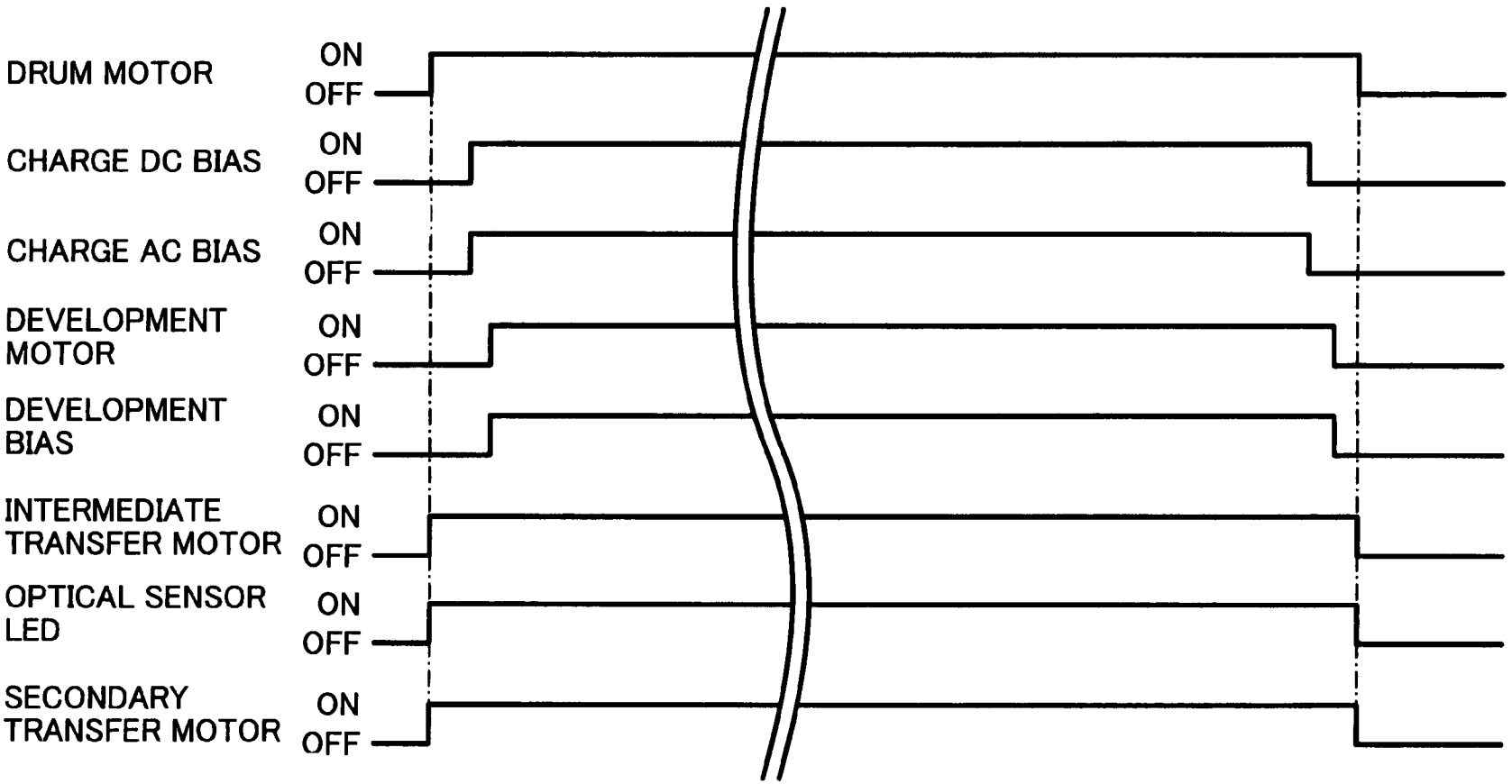
FIG. 13 is a chart illustrating on-off timings of the LED and a plurality of motors and biases included in the image forming apparatus of FIG. 2.

Referring to FIG. 13, a chart illustrates start timings of an each photoconductor drum motor, a charge DC bias, a charge AC bias, a development motor, the development bias, the intermediate transfer belt motor, the optical sensor LED, and the secondary transfer motor. As shown in the chart, motor loads, for example, the drum, the intermediate transfer belt, and the secondary transfer motors are activated, and the charge, the development, and the transfer biases are started according to a predetermined image forming timing. The intermediate transfer belt motor is activated so that the intermediate transfer belt 10 starts to drive, and simultaneously the LED of the optical sensor is turned on.

Referring to FIG. 14, a graph illustrates a relationship between the development potential calculated in the step S707 and the toner adhesion amount of the each reference patch.

Figure 15:
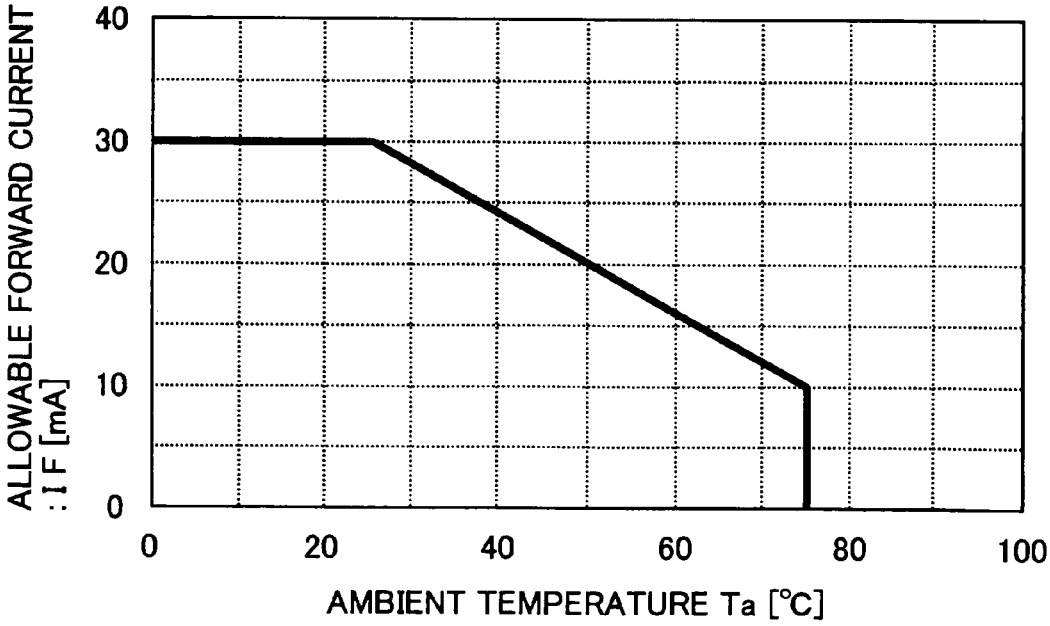
FIG. 15 is a graph illustrating a relationship between a temperature Ta in a vicinity of the LED and an allowable forward current IF of the LED.

Referring to FIG. 15, a graph illustrates a relationship between an ambient temperature Ta in an environment of the LED and an allowable forward current IF of the LED. In the LED, a current value generated by the LED needs to be determined according to the ambient temperature Ta because the current value allowable by the LED decreases as the temperature Ta increases.

Here, in a case where a reflection rate of the background unit of a detection target surface by the optical sensor is relatively high, in the Vsg adjustment, the emission amount of the LED needed for the light receiving element to receive a reflection light of a stipulated amount becomes relatively small. That is, a LED current value needed for the output voltage value from the optical sensor to be a stipulated value (e.g. 4.0±0.2V) becomes relatively small. For example, the LED current value needed to obtain 4.0V of the Vsg (Vsg=4.0V) is 4 to 7 mA in a case where the LED light is reflected at an opposing roller surface with using a transparent belt as the intermediate transfer belt and a metal roller having a high mirror reflection rate (20° gloss: 500) as an opposing roller of the optical sensor.

The image forming apparatus, on the other hand, employs a carbon dispersed belt (20° gloss: 120) having a change in a resistance with respect to a temperature and humidity environment as the intermediate transfer belt 10. This intermediate transfer belt 10 is colored in black by dispersing the carbon, and the mirror reflection rate is reduced to ¼, which is relatively low. In a case where this intermediate transfer belt 10 obtains 4.0V of the Vsg, the LED current is 20 to 35 mA which is 5 times larger than when using the transparent belt. Similarly, in a case of using a low gloss belt or a surface roughness belt, the LED current is relatively large.

As described above, the LED current needs to be within a range of the allowance forward current with respect to the ambient temperature. Thereby, the LED current with 20 to 35 mA may be difficult. A method of obtaining a predetermined Vsg while maintaining the LED current within the allowable forward current may include an enhancement of sensitivity of the light receiving element included in the optical sensor. That is, an enhancement of a gain of an operational amplifier. According to this method, 4.0V of the Vsg may be obtained while the LED current is maintained within the range of the allowance forward current. However, since this method simply amplifies a very weak light entering the light receiving element in terms of an electrical circuit, a high S/N ratio may not be obtained.

In this image forming apparatus, the gain of the operational amplifier is enhanced in addition to having a larger LED current value compared to a high reflection belt as a measure against the black intermediate transfer belt 10 being the detection target surface. Thereby, the LED current value is maintained within the allowable forward current, and an occurrence of decreasing the S/N ratio is reduced. Particularly, the LED current is set to be 15 mA in prospect of a maximum ambient temperature 50° C. and a ⅔ elapsed time reduction in the light amount. The operational amplifier is set to be 2.5 times in prospect of 20 to 35 mA (with a maximum width 15 mA) of a variation in the LED current with a maximum width 15 mA. Thereby, the S/N ratio needed for the optical sensor may be obtained on the black intermediate transfer belt 10 capable of providing a stable transfer performance without depending on the environment.

Figure 16:
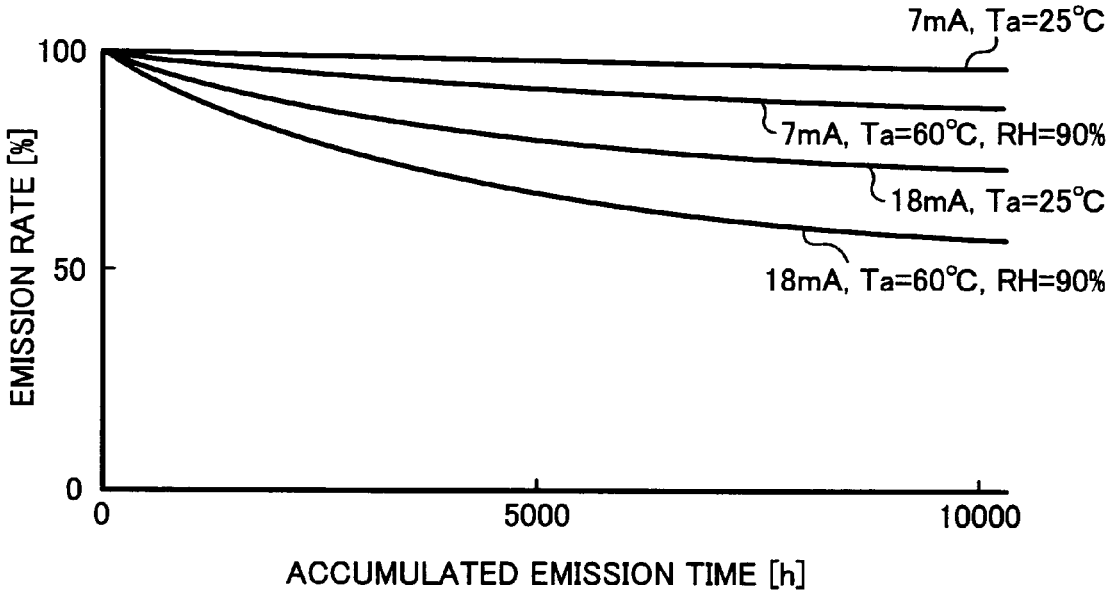
FIG. 16 is a graph illustrating a change in an emission amount of the LED involving a long-term usage.

Referring to FIG. 16, a graph illustrates a characteristic of the LED. The LED gradually increases a lattice defect while gradually decreasing the emission amount with a long term usage of the LED. A degree of a decrease in the emission amount varies depending on a LED material, however, it often depends on a current flown to the LED. The larger the current value, the larger the degree of the decrease in the emission amount with the elapsed time. In FIG. 16, an emission rate indicates a proportion of the emission amount at each point where the emission amount of the LED in an initial state is 100%. A reduction rate of the emission amount of the LED is higher as the current value is larger. A deterioration of the LED emission accelerates as the ambient temperature is higher.

In the image forming apparatus as described above, the LED is turned on when the image forming apparatus is started and maintains being on until the ending process so that an occurrence of an unnecessary waiting time during the self-check may be reduced. In the configuration of the image forming apparatus, an ON time period of the LED is longer compared to a situation of the related art where the LED is turned on and off when an optical detection is needed. Unlike the related art, an elapsed time reduction in the emission amount of the LED as shown in FIG. 14 is generated due to the longer ON time period. In a case of the regular optical sensor 110*a*, the reduction of the emission amount exerts less influence on a detection accuracy. However, in a case of the multi-reflection sensor 110*b*, the reduction of the emission amount exerts an influence on the detection accuracy.

Therefore, this image forming apparatus corrects the detection result so as to reduce an occurrence of reducing the detection accuracy by the elapsed time reduction in the emission amount with the multi-reflection sensor 110*b*. Thereby, a change in an output of the diffuse reflection light by the reduction in the light amount of the LED current is corrected.

The correction is explained. The correction stated above, for example in the step S707, is made when the color toner adhesion amount is calculated. Symbols used for explaining the correction are defined as follows.

Vsg: the output voltage value from the optical sensor which detects the background unit of the transfer belt (referring to a background detection voltage).

Vsp: the output voltage value from the optical sensor which detects each reference patch (referring to a patch detection voltage).

Voffset: the offset voltage (e.g., the output voltage value when the LED is OFF).

_reg.: the regular reflection light output

_dif.: the diffuse reflection light output (cf. JIS Z 8105 Glossary of color terms)

[n]: an element number (e.g., an array variable of n)

Figure 17:
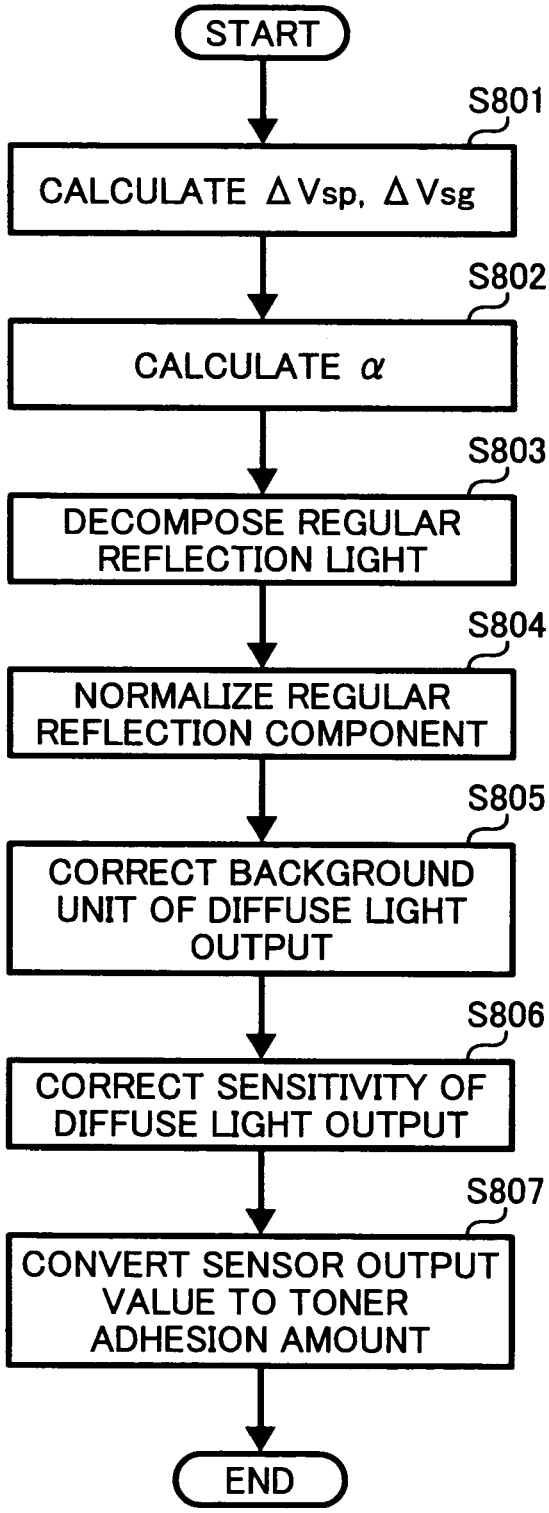
FIG. 17 is a flowchart for explaining an example calculation procedure of the toner adhesion amount.

Referring to FIG. 17, the color toner adhesion amount is calculated by an example procedure including a step S801 through S807.

In a step S801, a data sampling is performed so that a ΔVsp and a ΔVsg are calculated. Initially, the regular reflection light output, the diffuse reflection light output, and a difference between the offset voltage and all reference patches (quantity: n) are calculated. These calculations are performed so that an increment of the sensor output which is caused by a change in the color toner adhesion amount may be expressed eventually.

An increment of the regular reflection light output is determined by:

$$\Delta Vsp\ rep.\ [n]=Vsp_reg.\ [n]-Voffset_reg.$$

An increment of the diffuse reflection light output is determined by:

$$\Delta Vsp_dif.\ [n]=Vsp_dif.\ [n]-Voffset_dif.$$

Such a difference process may be omitted in a case where the operational amplifier is employed such that the offset output voltage (e.g., the Voffset_reg or the Voffset_diff) becomes a small enough to be ignored. This step S801 provides a characteristic curve shown in FIG. 18.

Figure 18:
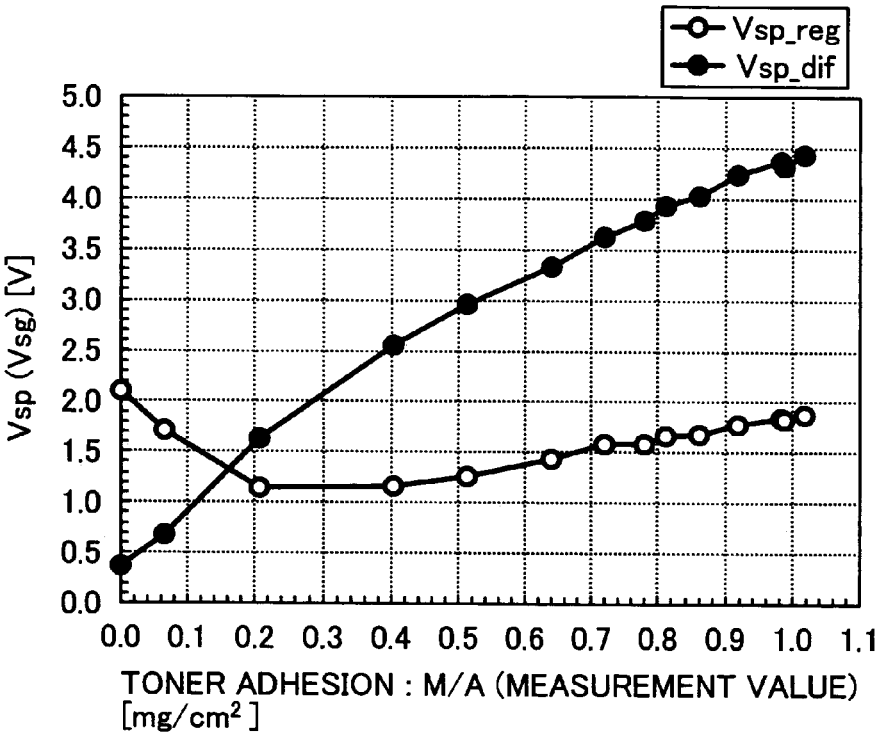
FIG. 18 is a graph illustrating relationships between the toner adhesion amount of the reference patch and a patch detection voltage Vsp and a background detection voltage Vsg.

Referring to FIG. 18, a graph illustrates relationships between the toner adhesion amounts of the reference patches and the patch detection voltage Vsp and the background detection voltage Vsg.

In a step S802 of FIG. 17, a sensitivity correction coefficient α is calculated. Initially, ΔVsp_reg. [n]/ΔVsp_dif. [n] for the each reference patch is calculated from the ΔVsp_reg. [n] or Vsp_dif. [n] determined in the step S801. The correction coefficient αneeded for a next step is calculated by:

$$\alpha=\min(\Delta Vsp_reg.\ [n]/Vsp_Dif.\ [n])$$

Where the sensitivity correction coefficient α is a minimum value between the ΔVsp_reg. [n] and the Vsp_dif. [n] because the minimum value for a regular reflection component of the regular reflection light output is nearly 0 and a positive which are known beforehand. This step S802 provides a characteristic curve shown in FIG. 19.

Figure 19:
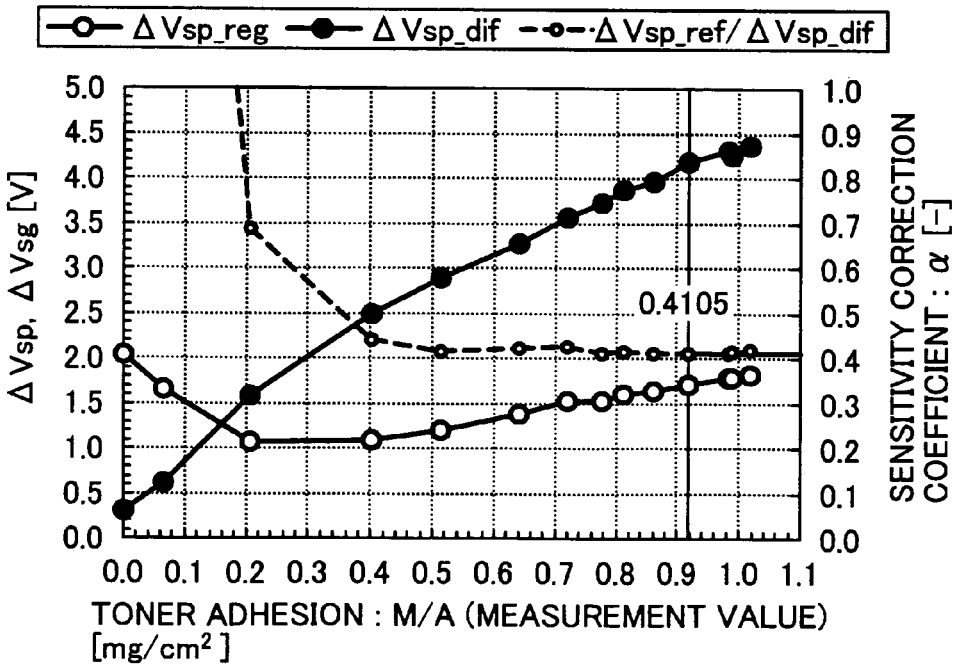

Referring to FIG. 19, a graph illustrates relationships among the toner adhesion amount, the ΔVsp and ΔVsg, and the sensitivity correction coefficient α.

In a step S803 of FIG. 17, a decomposition of the regular reflection light is performed. A diffuse light composition of the regular reflection light output is determined by:

$$\Delta Vsp_reg.\ dif.\ [n]=\Delta Vsp_dif.\ [n]\times\alpha$$

A regular reflection composition of the regular reflection light output is determined by:

$$\Delta Vsp_reg.\ reg.\ [n]=\Delta vsp_reg.\ [n]-\Delta Vsp_reg._dif.\ [n]$$

When the decomposition is performed, the regular reflection composition of the regular reflection light output becomes 0 at the patch detection voltage at which the coefficient α is determined. Therefore, the regular reflection light output is decomposed into the regular reflection composition and the diffuse light output as shown in FIG. 20

Figure 20:
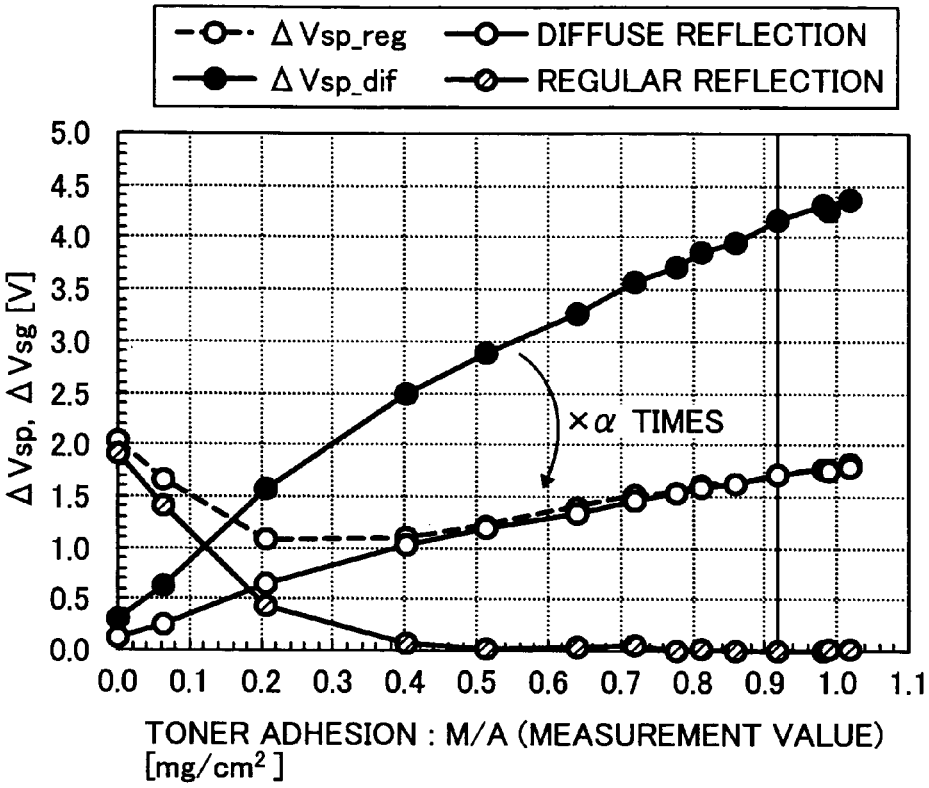
FIG. 20 is a graph illustrating relationships among the toner adhesion amount of the reference patch, a diffuse reflection component, and a regular reflection component.

Referring to FIG. 20, a graph illustrates relationships among the toner adhesion amount, the diffuse reflection component, and the regular reflection component.

In a step S804 of FIG. 17, the regular reflection component of the regular reflection light output is normalized. A ratio of the background detection voltage in each patch detection voltage is determined so as to convert to a normalized value from 1 to 4.

A normalized value β=an exposure rate of the background unit of the intermediate transfer belt =ΔVsp_reg._reg./ΔVsg_reg._reg.

Figure 21:
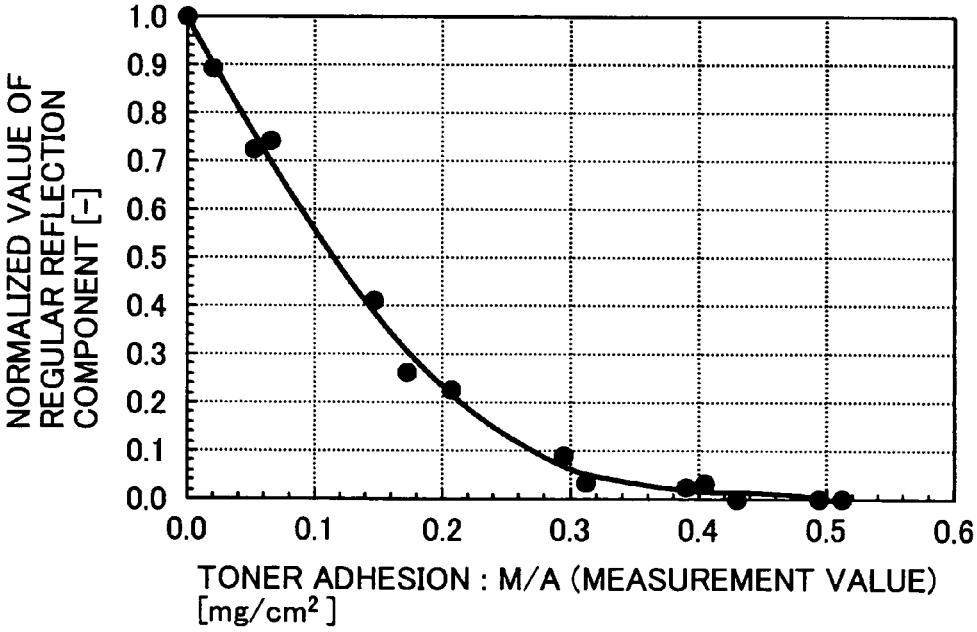
FIG. 21 is a graph illustrating a relationship between the toner adhesion amount and a normalized value of the regular reflection component in a regular reflection light.

This step S804 provides a characteristic curve as shown in FIG. 21.

Referring to FIG. 21, a graph illustrates a relationship between the toner adhesion amount and the normalized value of the regular reflection component in the regular reflection light.

In a step S805, a change in the background unit of the diffuse light output is corrected. The diffuse light output component from the belt background unit is removed from the diffuse light output voltage.

A post correction of the diffuse light output

=ΔVsp_dif.'

=the diffuse light output voltage−the background detection voltage×the normalized value of the regular reflection component $$=\Delta Vsp_dif.(n)-\Delta Vsg_dif.\times\beta(n)$$

Figure 22:
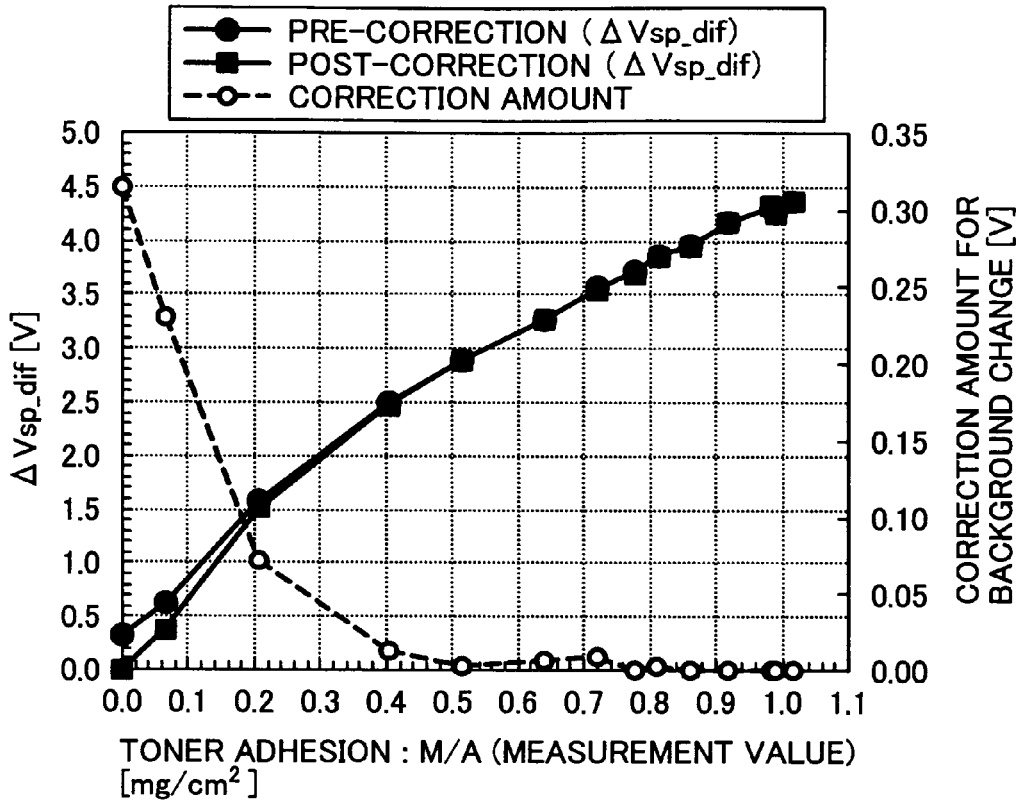
FIG. 22 is graph illustrating relationships among the toner adhesion amount, a ΔVsp diffuse reflection, and a correction amount of a change in a background unit.

Therefore, an influence on the background unit of the intermediate transfer belt 10 may be removed. In an area of a low adhesion amount having the sensitivity by the regular reflection light output, the diffuse light component directly reflected from the belt background unit may be removed from the diffuse light output. The post-correction of the diffuse light output in a range of the toner adhesion amount from 0 to 1 layer is converted to a value as shown in FIG. 22. This value passes an original point, and is a primary linear relation with respect to the toner adhesion amount.

Referring to FIG. 22, a graph illustrates relationships among the toner adhesion amount, the ΔVsp_dif., and a correction amount for a change in the background. The correction amount of the change in the background unit is an amount of a change in the background unit of the diffuse light output which is corrected.

Figure 23:
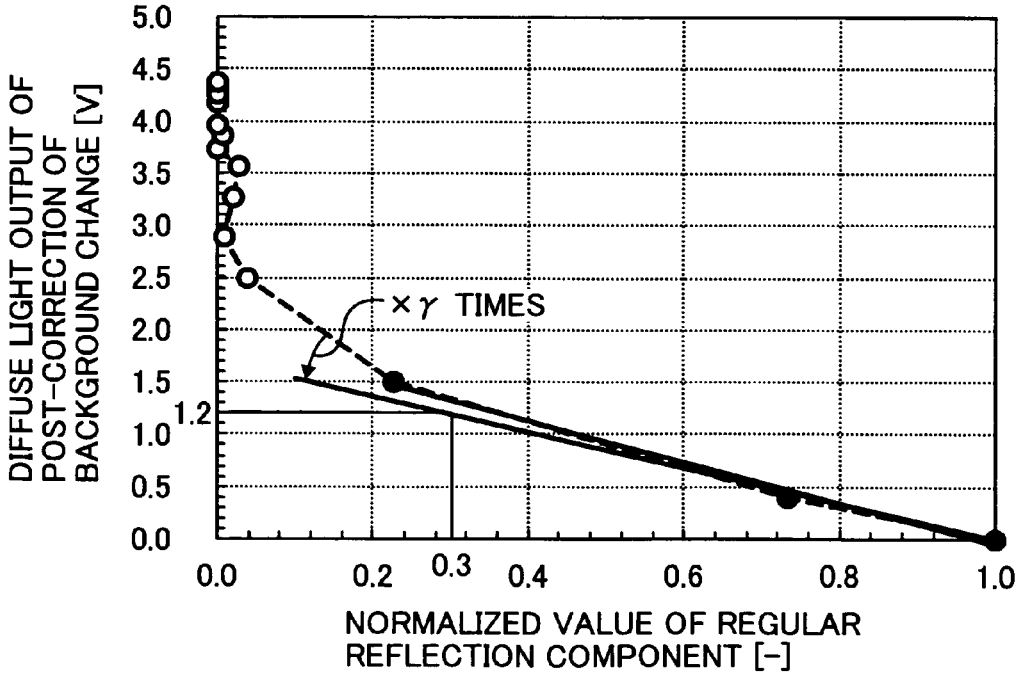
FIG. 23 is a graph illustrating a relationship between the normalized value of the regular reflection component in shading and an output value by a diffused light after a correction of the change in the background unit.

In a step S806 of FIG. 17, the sensitivity of the diffuse light output is corrected, particularly, as shown in FIG. 23.

Referring to FIG. 23, the diffuse light output of a change in the background unit in the post-correction is plotted with respect to the normalized value of the regular reflection component in the regular reflection light so that the sensitivity of the diffuse light output is determined based on a linear relation in the low adhesion amount area of the toner. The sensitivity is corrected such that a predetermined target sensitivity is obtained. Here, the sensitivity of the diffuse light output refers to a gradient of a line shown in FIG. 23. A correction coefficient multiplying with respect to a certain current gradient is calculated such that the gradient of the line causes the change in the background unit in the post-correction for a normalized value to be a predetermined value (e.g., x, y=0.3, 1.2 in the graph). Thereby, a measurement result of the output voltage value is corrected.

The gradient of the line is determined by a least square method below.

X=a mean value of the normalized value of the regular reflection component in the regular reflection light y=Y−the gradient of the line x X x [i]=the normalized value of the regular reflection component in the regular refection light (where a range of x is $0.06 \leqq x \leqq 1$)

y [i] =the diffuse light output of the change in the background unit in the post-correction Y=a mean value of the diffuse light output of the change in the background unit in the post-correction The gradient of the line $$=\Sigma(x[i]-X)(y[i]-Y)/\Sigma(x[i]-X)2$$

In this image forming apparatus, a lower limit of the x for the calculation is 0.06. However, the lower limit may be optionally determined within a range in which the x and y has the leaner relation. An upper limit is set to be 1 because the normalized value is between 0 to 1.

According to the sensitivity determined, a sensitivity correction coefficient γ is determined such that a normalized value a to be calculated becomes a value b.

The sensitivity correction coefficient: γ

=b/(the gradient of the line x a+y intercept)

The diffuse light output of the change in the background unit in the post-correction determined in the step S805 is corrected by multiplying the sensitivity correction coefficient γ.

The diffuse light output of the sensitivity in the post-correction

=ΔVsp_dif."

=the diffuse light output of the change in the background unit in the post-correction x the sensitivity coefficient γ

=ΔVsp_dif. (n)' x the sensitivity correction coefficient γ

In a step S807 of FIG. 17, the sensor output value is converted to the toner adhesion amount. Up to the step S806, all correction processes with respect to the change in the diffuse reflection output with the elapsed time caused by a reduction of the LED light amount are performed, for example. The sensor output value is converted to the toner adhesion amount based on the conversion table for the adhesion amount.

A second exemplary embodiment of the image forming apparatus of the present invention is described. As a configuration of the second exemplary embodiment is similar to the exemplary embodiment described above, a detailed description is omitted.

As described above in the exemplary embodiment, the image forming apparatus of the second exemplary embodiment is capable of reading the image information of the original by the scanner 300 to obtain image information. The image forming apparatus is also capable of obtaining the image information sent from an external personal computer by a printer interface (not shown) as the image information input mechanism. The toner image is formed on the transfer sheet 5 based on the image information obtained by the image information input mechanism.

The image forming apparatus of the second exemplary embodiment counts a number of print-out sheets by a related art count circuit (not shown) after performing the self-check. A number of the print-out sheets are determined by a determination circuit (not shown) whether or not a count number of the sheets reaches a predetermined number, for example, 200 sheets. When the determination circuit determines that the count number reaches the predetermined number, an execution signal for requesting the self-check is output to the control unit including the CPU 501, the ROM 503, and the RAM 504.

When the control unit receives the execution signal from the determination circuit during a continuous print operation, the control unit interrupts the continuous print operation so as to perform the self-check. The continuous print operation performs a print-out continuously with respect to a plurality of the transfer sheets 5.

When the continuous print operation is interrupted, the Vsg adjustment (e.g., the step S704 of FIG. 12) in the self-check may be begun by turning on the LED of the optical sensor immediately after receiving the execution signal because a process control is in a state of being started. However, in such a process, the waiting time is needed for stabilizing the emission amount of the LED before a Vsg detection.

In this image forming apparatus, when an operator commands the control unit to start the process control for forming the toner image based on the image information obtained by the scanner 300 or the printer interface, the LED of the optical sensor is turned on regardless of a detection result by the detection circuit. In the continuous print operation, the print job with respect to at least one transfer sheet needs to be performed so that an accumulated number of the print-out sheets may reach the predetermined number. Therefore, when the process control is started to begin the continuous print operation, with the LED of the optical sensor being turned on, the emission amount of the LED is stabilized even if the accumulated number of the print-out sheets reaches the predetermined number, and the execution signal is output from the determination circuit. Thereby, an occurrence of the lengthy duration caused by waiting for the self-check may be reduced without stabilizing the emission amount of the LED during the self-check. When the LED is turned on upon start-up of the image forming apparatus in an initial state of the continuous print operation, the LED maintains being on until the ending process of the image forming apparatus in a later state of the continuous print operation regardless of a presence or absence of the self-check. Therefore, the LED maintains being on until at least all the reference patches are detected.

A third exemplary embodiment of the image forming apparatus of the present invention is described.

Like the second exemplary embodiment, the third exemplary embodiment of the image forming apparatus counts a number of the print-out sheets by a related art count circuit (not shown) after performing the self-check. A number of the print-out sheets are determined by the determination circuit (not shown) whether or not the count number of the sheets reaches the predetermined number, for example, 200 sheets. In a case of reaching the predetermined number of the sheets, the execution signal for requesting the self-check is output to the control unit.

When the image information with respect to the plurality of transfer sheets 5 is continuously sent from the external personal computer to the image information input mechanism, for example, when the image information with respect to an individual transfer sheet for the continuous print operation is sent, the count number may be predicted during the continuous print operation whether or not the predetermined number to be reached. For example, under an instruction of performing the self-check at a point in time when the count number reaches 200 sheets, in a case where the count number is 189 sheets before the continuous operation is performed, and the image information with respect to 20 transfer sheets is continuously sent from the personal computer, the execution signal may be predicted to be output from the determination circuit at a time of printing out a 11th sheet.

In this image forming apparatus, the count number is predicted during the continuous print operation whether or not to reach the predetermined number of sheets based on the image information continuously sent from the personal computer. Thereby, the control unit is configured to perform a control of turning on the LED before the execution signal is output when the count number is predicted to reach the predetermined number. The control unit functions as a prediction mechanism. In this configuration, as the emission amount of the LED may also be stabilized before the execution signal is output, an occurrence of prolonging the self-check caused by waiting for a stabilization of the emission amount may be reduced. In the image forming apparatus, when the LED is turned on during the continuous print operation, the LED maintains being on until the image forming apparatus is finished in the later state of the continuous print operation. Thereby, the LED maintains being on until at least all the reference patches are detected.

A transformation example of the third exemplary embodiment of the image forming apparatus is described.

In the transformation example, a related art clock circuit (not shown) clocks the elapsed time after the self-check is performed. The determination circuit (not shown) determines whether or not a clock value clocked by the clock circuit reaches a predetermined value, for example, 40 hours. The clock circuit (referring to the preliminary condition determiner) outputs the execution signal for the self-check to the control unit including the CPU 501, the ROM 503, and the RAM 504 when the clock value reaches the predetermined value.

The control unit continuously prints out with respect to the plurality of transfer sheets 5. When the control unit receives the execution signal from the determination circuit during the continuous print operation, the control unit interrupts the continuous print operation so as to perform the self-check.

In the transformation example, a time needed for the print job with respect to one transfer sheet is determined beforehand. When a print command is issued, the clock value may be predicted during a print operation whether or not the clock value reaches the predetermined value regardless of performing the continuous print operation or a 1 job print operation.

In the transformation example of the image forming apparatus, the clock value is predicted during the continuous print operation when the print command is issued whether or not the clock value reaches the predetermined value. Thereby, the control unit is configured to perform the control of turning on the LED before the execution signal is output when the clock value is predicted to reach the predetermined value. The control unit functions as the prediction mechanism. In this configuration, as the emission amount of the LED may also be stabilized before the execution signal is output, an occurrence of prolonging the self-check caused by waiting for the stabilization may be reduced.

In the above explanation, a reflection optical sensor is used as the optical sensor. The reflection optical sensor receives a reflection light, the light receiving element being the receiving mechanism. The reflection light is obtained by reflecting a light emitted from the LED which is the emission mechanism at a detection target surface. However, a transmission optical sensor may be used as the optical sensor. When the transmission optical sensor is used, a material having a light transmission capability is used as the intermediate transfer belt 10, and the receiving mechanism receives a transmission light obtained by transmitting the light emitted from emission mechanism to the belt. The toner adhesion amount of the reference toner patch is determined based on the light receiving amount of the transmission light by the receiving mechanism.

Figure 24:
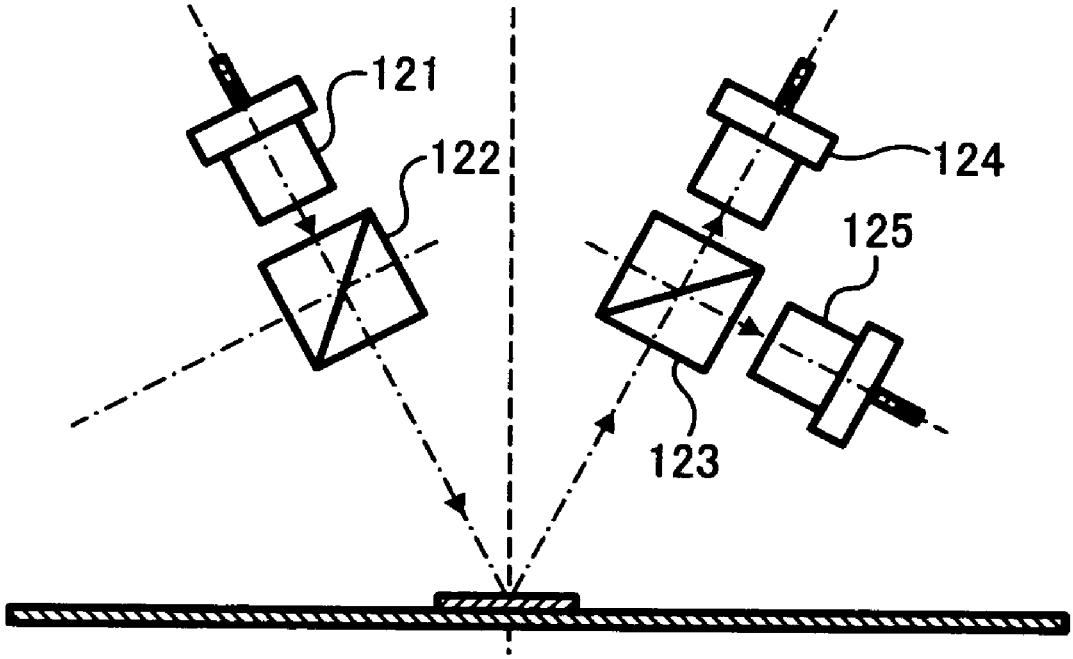
FIG. 24 is an enlarged diagram illustrating the optical sensor of a beam splitter type.

A device having a configuration shown in FIG. 24 may be used as the optical sensor.

Referring to FIG. 24, the device includes a LED 121, a deflecting filter 122, a beam splitter 123, a first light receiving element 124, and a second light receiving element 125. The LED 121 is the emission mechanism to emit a light having P and S deflective components. The deflecting filter 122 cuts the deflective component. The beam splitter 123 splits the light. The first light receiving element 124 receives the P deflecting component. The second light receiving element 125 receives the S deflecting component.

When the light having the P and S deflecting components emitted from the LED 121 passes through the deflecting filter 122, the S deflective component is cut so that the P deflective component is remained and reflected at the detection target surface, and becomes the reflection light. Here, a polarization is disturbed by the reflection so that the reflection light includes the P and S deflecting components again. When the reflection light passes through the beam splitter 123, the P deflecting component travels in a direction which is the same as before entering into the beam splitter while the S deflecting component travels in a direction which is inclined by 90°. Thereby, the P and S deflecting components are split. The P and S deflecting components after passing through the beam splitter 123 are respectively received by the first and second receiving elements 124 and 125.

The exemplary embodiments described above are configured to transfer the toner image on the photoconductor 20 onto the transfer sheet 5 through the intermediate transfer belt 10. The exemplary embodiments may also be configured to dispose a conveyance belt to convey the transfer sheet in a location opposing to the photoconductor, and the toner image on the photoconductor is directly transferred onto the transfer sheet being transferred with the transfer sheet being held onto a surface of the conveyance belt. In this configuration, the reference patch is transferred onto a surface of the conveyance belt, not onto the transfer sheet being held onto the surface of the conveyance belt. Thereby, the reference patch on the surface of the conveyance belt may be detected by the optical sensor.

The image forming apparatus capable of forming the toner image of a plurality of colors by superimposing transfer processes is described above. However, exemplary embodiments of the present invention may also apply to an image forming apparatus capable of forming a single color toner image.

In addition, the tandem image forming apparatus including the four photoconductors on which the toner images of different colors are formed are described above. In the tandem image forming apparatus, the toner images of the different colors are superimposed and then transferred so that a toner image of a multiple colors is formed. However, exemplary embodiments of the present invention may apply to an image forming apparatus capable of forming the toner image of a multiple colors with one photoconductor which is illustrated in FIG. 25.

Figure 25:
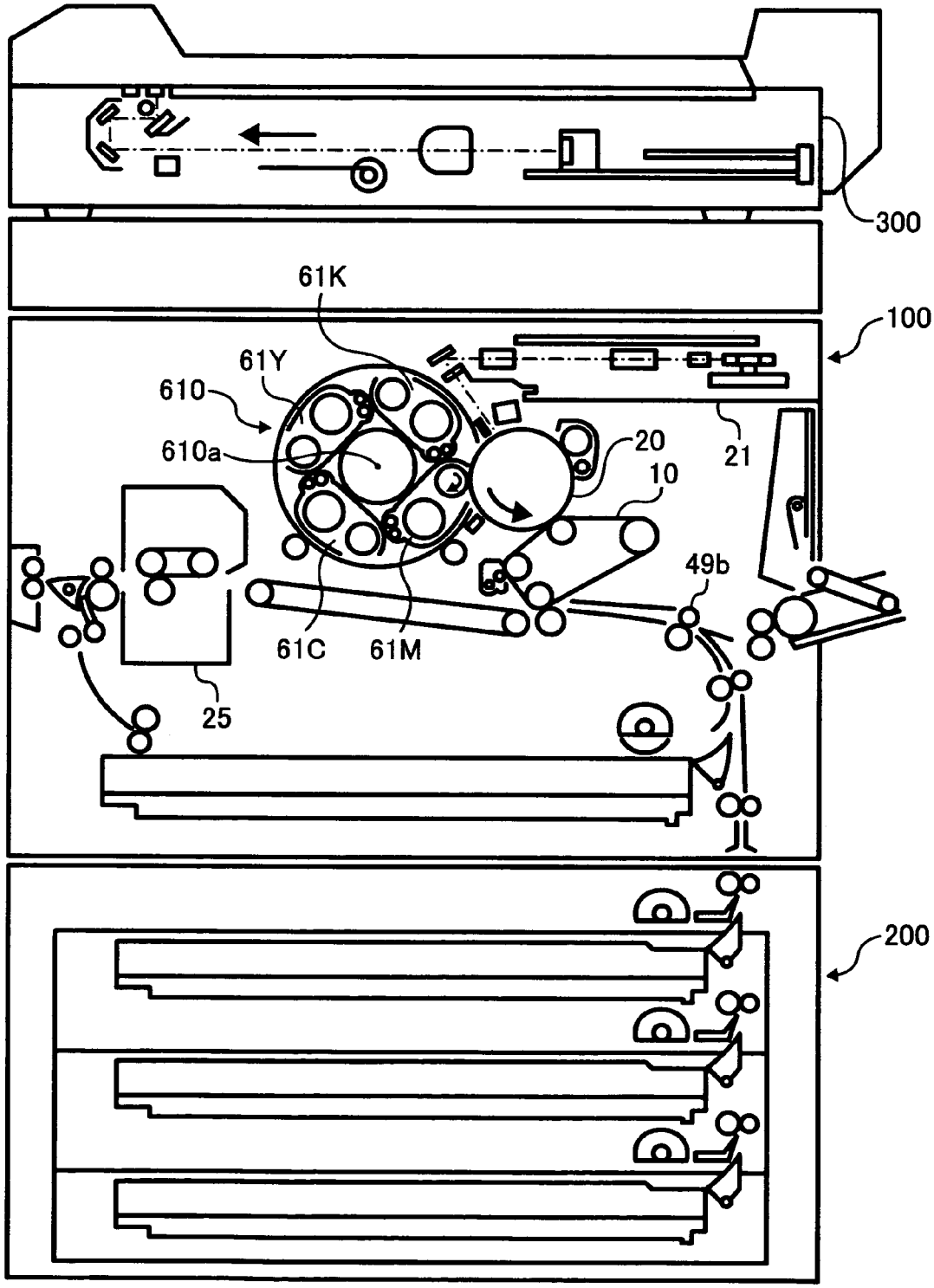
FIG. 25 is a schematic diagram of an image forming apparatus having a rotary development device.

Referring to FIG. 25, a schematic diagram illustrates an example configuration of the image forming apparatus having one photoconductor for forming the multiple color image. Devices and units of FIG. 25 functioned similar to those of FIG. 2 are indicated in the same reference numerals as FIG. 2. This image forming apparatus includes a rotary development device 610 and a rotation axis 610*a*. The rotary development device 610 holds the development devices 61Y, 61C, 61M, and 61K. The rotation axis 610*a* rotates so that an optional photoconductor among four is moved to a development position. As shown in FIG. 25, one photoconductor 20 is disposed above the intermediate transfer belt 10, and the rotary development device 610 is disposed in a lateral direction (e.g., a left lateral in FIG. 25) of the photoconductor 20. In the rotary development device 610, the development devices 61Y, 61C, 61M, and 61K are disposed in a normal line direction around the rotation axis 610*a*. When the rotation axis 610*a* rotates, the optional photoconductor among four is moved to the development position opposing to the photoconductor 20. The electrostatic latent image of Y, C, M, and K are sequentially formed on the surface of the photoconductor 20 so as to be sequentially developed by the development devices of respective colors. The developed toner images of the Y, C, M, and K colors are sequentially superimposed on the transfer belt 10 so as to be transferred.

The control unit above is configured to correct the result detected by the diffuse reflection light based on the comparison between the results detected by the regular optical sensor 110*a* and the multi-reflection sensor 110*b*. A result detected by the regular optical sensor 110*a* shows the regular reflection lights for the plurality of respective reference patches. Each of the reference patches has the different toner adhesion amount per unit area. Another result detected by the sensor 110*b* shows the diffuse reflection lights for the plurality of respective reference patches. However, the control unit may be configured to correct a detection result of the diffuse reflection light obtained by one reference patch based on a detection result of the regular reflection light obtained by the one reference patch as disclosed by a related art technique.

The control unit as the correction mechanism may be configured to correct the output value for the diffuse reflection light of the optical sensor by another related art technique. In this related art correction technique, a reference member may be inserted between the intermediate transfer belt 10 and the optical sensor. The optical sensor may be turned so as to aim at the reference member. The diffuse reflection light in the reference member is detected so that the correction of the output value is made based on the detection result.

The third exemplary embodiment of the image forming apparatus above causes the control unit to predict during the continuous print operation whether or not a quantity condition of printing out the predetermined number of sheets is satisfied based on the image information obtained by the printer interface or the scanner 300. The quantity condition becomes a trigger for performing the self-check. In this configuration, as stated above, the control unit accurately predicts during the continuous print operation whether or not the condition is satisfied, and the emission amount of the LED may be stabilized as may be needed before the self-check.

The third exemplary embodiment causes the control unit to predict during the continuous print operation whether or not a time condition of elapsing the predetermined time is satisfied based on the result clocked by the clock circuit which clocks the elapsed time from a predetermined point in time. The time condition becomes the trigger for performing the self-check. In this configuration, the control unit accurately predicts during the continuous print operation whether or not the time condition is satisfied, and the emission amount of the LED may be stabilized as may be needed before the self-check.

The exemplary embodiments of the image forming apparatus include, for example, the photoconductor, the laser writing device 21, the development device 61, and the primary transfer device 62 as an image forming mechanism to form a toner image. The image forming mechanism which transfers the reference patch developed on the photoconductor onto the intermediate transfer belt 10 is used. The reference patch on the transfer belt 10 is detected by the optical sensor. In this configuration, as stated above, the LED is turned on at the early timing so that an occurrence of the lengthy duration of the self-check may be reduced without the light fatigue of the photoconductor by irradiation of the LED light.

In addition, the exemplary embodiments of the image forming apparatus cause the control unit to control the calculation for a value of setting an image forming condition or the optical writing γ based on the light reflection amounts for each respective reference patch after the plurality of reference patches are formed when the self-check is performed. The image forming condition includes the Vd, Vb, and VL. The image forming condition may be appropriately set based on the detection result of the light reflection amounts for the plurality of reference patches.

The exemplary embodiments of the image forming apparatus above causes the control unit to control a formation of the gradation pattern image. The gradation pattern image includes the plurality of reference patches each of which has the per unit area of the different toner adhesion amount. The development γ or the optical wring γ may be appropriately adjusted based on the detection result for the respective reference patch included in the gradation pattern image.

The exemplary embodiments of the image forming apparatus causes the control unit to control the LED to maintain being on until the reflection light amount is detected for at least all the reference patches when the LED begins emitting the light for the self-check. In this configuration, during the self-check as stated above, an occurrence of the waiting time caused by turning on and off in a case of the optical detection may be reduced.

In the exemplary embodiments of the image forming apparatus, the multi-reflection sensor 110*b* detecting the diffuse reflection light from the detection target is used as the light receiving element, and the result detected by the multi-reflection sensor 110*b* is corrected by the correction mechanism. In this configuration, as stated above, the toner adhesion amounts for the reference patches of the Y, C, and M colors are accurately detected, and an occurrence of reducing the detection accuracy by increasing an emission time of the LED may be reduced.

Numerous additional modifications and variations are possible in light of the above teachings. It is therefore to be understood that within the disclosure of this patent specification the invention may be practiced otherwise than as specifically described herein.

The invention claimed is:

1. An image forming apparatus, comprising:

a plurality of photoconductors;

an image carrying member;

an image forming mechanism configured to perform a reference image forming operation that transfers, from the photoconductors, a reference toner image to the image carrying member under a specific setting associated with the image forming mechanism;

an optical sensor arranged in a vicinity of the image carrying member that includes a light emitter that emits light to impinge on the image carrying member and a light receiver that receives the light reflected from the image carrying member; and a controller configured to perform an optical toner test that checks, via the optical sensor, optical characteristics of the reference toner image formed on the image carrying member by controlling the light emitter to emit the light and that adjusts the specific setting based on a result of the optical toner test, wherein the controller causes the light emitter of the optical sensor to start emitting the light at a time the image carrying member is started to be driven when the image carrying member is at rest, wherein the controller performs a self-check in which the optical toner test is performed immediately after a power supply, that supplies power to the image forming apparatus, is activated, wherein the self-check includes adjusting an emission amount of the light emitter, adjusting a potential based on the reference toner image, calculating a development gradient, and correcting the development gradient, and wherein the optical sensor continuously emits the light during the self-check and ceases emitting the light when the self-check is completed.

2. The apparatus of claim 1, further comprising:

a preliminary condition determiner configured to determine as to whether a preliminary condition is satisfied, and wherein the controller further performs the optical toner test under a condition that the preliminary condition is satisfied, as determined by the preliminary condition determiner.

3. The apparatus of claim 2, wherein the controller further causes the light emitter of the optical sensor to start emitting light at a time the image carrying member is started to be driven in a case where the image carrying member is at rest between image forming operations.

4. The apparatus of claim 2, further comprising:

an image information input mechanism configured to enter an input image information to be subjected to an image forming operation; and a state predicting mechanism configured to predict an event in which the preliminary condition is satisfied during the image forming operation with respect to the input image information entered by the image information input mechanism, and wherein the controller performs the optical toner test based on a result of prediction predicted by the state predicting mechanism.

5. The apparatus of claim 4, wherein the preliminary condition determiner is further configured to determine that the preliminary condition is satisfied when a cumulative number of times that the image forming operation is performed reaches a predetermined value, and wherein the state predicting mechanism is further configured to predict an event in which the preliminary condition is satisfied during the image forming operation with respect to the input image information entered by the image information input mechanism based on a result of entrance of the input image information by the image information input mechanism.

6. The apparatus of claim 4, further comprising:

a timer configured to measure time elapsed after a performance of a parameter adjustment is completed, the preliminary condition determiner is further configured to determine that the preliminary condition is satisfied when the time measured by the timer reaches a predetermined value, and wherein the state predicting mechanism is further configured to predict an event in which the preliminary condition is satisfied during the image forming operation with respect to the input image information entered by the image information input mechanism based on a result of a comparison of the time measured by the timer to a time length until the image forming operation is completed with respect to the input image information entered by the image information input mechanism.

7. The apparatus of claim 4, wherein the light emitter begins to emit the light during the image forming operation when the state predicting mechanism predicts the event in which the preliminary condition is satisfied.

8. The apparatus of claim 1, wherein the image carrying member includes an intermediate image transfer member.

9. The apparatus of claim 1, wherein the reference toner image includes a plurality of basic reference toner images, and the controller is further configured to perform the optical toner test for checking, by using the optical sensor, optical characteristics of each of the plurality of the basic reference toner images, included in the reference toner image, which are formed on the image carrying member and to adjust the specific setting based on a result of the toner optical test with respect to each of the plurality of basic reference toner images.

10. The apparatus of claim 9, wherein the plurality of basic reference toner images are different in a toner amount per a unit area from each other.

11. The apparatus of claim 9, wherein the controller is further configured to cause the light emitter of the optical sensor to continue to emit the light until the controller completes the optical toner test relative to every one of the plurality of basic reference toner images.

12. The apparatus of claim 1, wherein the light receiver of the optical sensor includes a diffusion reflection light receiver to receive diffusion reflection light, and a correction mechanism configured to correct a detection result from the diffusion reflection light receiver.

13. The apparatus of claim 12, wherein the correction mechanism corrects a detection result relative to the reference toner image based on a detection result relative to a surface of the image carrying member.

14. The apparatus of claim 1, wherein the light receiver of the optical sensor includes a diffusion reflection light receiver to receive diffusion reflection light, a regular reflection light receiver to receive regular reflection light, and a correction mechanism configured to correct a detection result by the diffusion reflection light receiver relative to the diffusion reflection light reflected from the reference toner image based on a detection result by the regular reflection light receiver relative to the regular reflection light reflected from the reference toner image.

15. The apparatus of claim 1, wherein the reference toner image includes a plurality of basic reference toner images which are different in a toner amount per a unit area from each other, and wherein the light receiver of the optical sensor includes a diffusion reflection light receiver to receive diffusion reflection light, a regular reflection light receiver to receive regular reflection light, and a correction mechanism configured to correct a detection result by the diffusion reflection light receiver relative to the diffusion reflection light reflected from each one of the plurality of basic reference toner images included in the reference toner image, based on a detection result by the regular reflection light receiver relative to the regular reflection light reflected from each one of the plurality of basic reference toner images included in the reference toner image.

16. The apparatus of claim 1, wherein an output voltage of the optical sensor is measured at a beginning of the self-check prior to the time where the controller controls the light emitter of the optical sensor to start emitting the light.

17. The apparatus of claim 1, wherein the controller distinguishes a state that the power supply is activated from an abnormal state by determining whether a surface temperature of a fixing roller of a fixing device is below a predetermined value.

18. The apparatus of claim 17, wherein the predetermined value is 100° C.

* * * * *